US008261966B2

(12) United States Patent
Cox et al.

(10) Patent No.: US 8,261,966 B2
(45) **Date of Patent: *Sep. 11, 2012**

(54) APPARATUS FOR SECURE POSTAL AND PARCEL RECEIPT AND STORAGE

(75) Inventors: Bobbie Cox, Dallas, TX (US); Jeffrey Kalman, Cleveland Heights, OH (US); Craig Saunders, Rocky River, OH (US); Lindsey Tufts, Jr., Eastlake, OH (US); Chuck Hosier, Dallas, TX (US); Paul Stephens, Twinsburg, OH (US)

(73) Assignee: Postal Hawk Corporation, Dallas, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/179,159

(22) Filed: Jul. 8, 2011

(65) Prior Publication Data

US 2011/0259950 A1 Oct. 27, 2011

Related U.S. Application Data

(63) Continuation of application No. 12/576,431, filed on Oct. 9, 2009, now Pat. No. 7,988,035.

(51) Int. Cl.
*B65G 11/04* (2006.01)

(52) U.S. Cl. ..... 232/47; 232/39; 232/51; 232/54; 248/146; 248/519; 52/296

(58) Field of Classification Search ..... 232/47–52, 232/45, 17, 54, 39, 43.5; 248/519, 346.01, 248/146, 156; 52/294–297
See application file for complete search history.

(56) References Cited

U.S. PATENT DOCUMENTS

| | | | | |
|---|---|---|---|---|
| 450,379 | A * | 4/1891 | Sinclaire | 232/51 |
| 722,323 | A * | 3/1903 | Parker | 232/54 |
| 5,207,377 | A * | 5/1993 | Brecht | 232/17 |
| 5,526,979 | A * | 6/1996 | Mann | 232/33 |
| 5,740,645 | A * | 4/1998 | Raby | 52/297 |
| 5,901,525 | A * | 5/1999 | Doeringer et al. | 52/835 |
| 5,938,113 | A * | 8/1999 | Kim | 232/47 |
| 6,247,642 | B1 * | 6/2001 | Wilson, Jr. | 232/47 |
| 6,375,071 | B1 * | 4/2002 | Kim | 232/47 |
| 7,219,873 | B2 * | 5/2007 | Harwood | 248/519 |
| 7,252,220 | B1 * | 8/2007 | Shreve | 232/45 |
| 2009/0272053 | A1 * | 11/2009 | Dent | 52/296 |

* cited by examiner

*Primary Examiner* — William L. Miller
(74) *Attorney, Agent, or Firm* — Andrews Kurth LLP

(57) ABSTRACT

A receptacle for secure mail and parcel receipt and storage. The receptacle includes a top which provides a roof for the receptacle, a base, and a housing connected to the top and the base. The housing includes an upper compartment into which mail is first placed, a lower compartment into which mail is deposited from the upper compartment, a front door, located on a front of the receptacle, which is opened to provide access to the upper compartment and through which mail is placed into the upper compartment, a trap door, operatively connected to the front door, in the upper compartment, and an access door that includes a lock. The trap door rests in an open position when the front door is closed, allowing communication between the upper and lower compartments. The trap door is moved to a closed position by the opening of the front door, thereby preventing access to the lower compartment from the upper compartment. The trap door returns to the open position when the front door is closed, depositing any mail placed in the upper compartment into the lower compartment. The access door is unlocked and opened to provide access to the lower compartment, whereby mail deposited and stored in the lower compartment may be retrieved through the access door.

15 Claims, 33 Drawing Sheets

APPARATUS FOR SECURE POSTAL AND PARCEL RECEIPT AND STORAGE

RELATED APPLICATION

This application is a continuation application of U.S. patent application Ser. No. 12/576,431, now U.S. Pat. No. 7,988,035, entitled "APPARATUS FOR SECURE POSTAL AND PARCEL RECEIPT AND STORAGE," filed on Oct. 9, 2009, the content of which is incorporated herein by reference in its entirety.

BACKGROUND

Receptacles, such as mailboxes and other depositories for various items, have been in use for many years. Typically a mailbox is located along a roadway or in the wall of a home for delivery and pickup of mail. Typical conventional mailboxes that are readily accessible to authorized delivery and pickup persons are also generally accessible to unauthorized persons. Therefore, such conventional mailboxes leave a person's mail and packages susceptible to theft, vandalism, and lack of privacy. With the increased popularity of "e-commerce" and the associated common carrier delivery of purchased items as packages, the need for enhanced security of delivery receptacles has become acute.

Also, when someone is away from home for several days or weeks, mail that is continually delivered on a daily basis accumulates in the person's mailbox. The accumulated mail not only jams conventional mailboxes, but also can provide a signal to burglars and vandals that the person is away from home for an extended period, thus marking the person's home as an easy target for a burglary or vandalism. While the person can request Post Office personnel to withhold mail delivery or ask a neighbor to collect his mail during his absence, there are times when these solutions are impractical. For example, the person might leave on short notice or forget to make arrangements with the Post Office or a neighbor until the last minute before leaving, when it might be after hours or too late or too inconvenient to make such arrangements. Also, such arrangements themselves can be a means of disseminating the information that the person is planning to be gone and the length of his absence, which information, through careless or unscrupulous postal employees or neighbors, can get to burglars or vandals. It is often more desirable, therefore, to simply say nothing and allow mail, newspapers, and the like to accumulate during a short absence. In such situations, a mailbox having a locked, high-volume storage compartment for mail to accumulate would be desirable. It would also be desirable to have the mail accumulate out of sight so that a potential burglar could not see the mail accumulation. Yet, when the person is home, he might prefer a normal mailbox for sending and receiving his mail. Thus, there is a need for a delivery receptacle that is easily convertible between normal and high-volume configurations.

A number of mailboxes have been made to provide security for the deposited items by having the items pass through a trap mechanism into a security area when the door is dosed, so that the items cannot be returned through the trap mechanism when the door is opened. Such arrangements have excessive mechanical parts that wear and break or are affected by moisture, ice, or snow, and have been relatively expensive to manufacture and unreliable in use, thus limiting their successful uses by typical consumers. Some attempts using trap mechanisms have provided mechanisms attached to the flag to deflect the operation of the trap when mail was to be picked up by the postman, resulting in additional manufacturing costs. Many times the postman would first lower the flag and unknowingly deposit the mail to be picked up into the secured compartment. Also, many of the prior attempts only had small storage spaces with no provision for holding accumulated mail in a secured chamber while in the absence of the patron. Also prior attempts made no adequate or easily operable provision to allow the optional use of the device as an ordinary unsecured mailbox with a selectable alternate use for secured, long-term retention and storage of delivered items.

In summary, while there have been a number of prior attempts to solve the problems of providing a secure storage of mail or other items, there is still a substantial, unfulfilled need for an improved mailbox that is simple to operate, to produce, easy to gain access and pick up mail on a stationary shelf in normal configuration, optionally convertible to secured, high-volume configuration prevent theft, and has a large enough compartment for adequate storage of items accumulated out of sight for at least several days or weeks until they are collected. Yet, the receptacle must be accessible to the mail delivery person without keys or the necessity to open the locked compartment for delivery or pick up, and which can be understood and used readily by any delivery person without prior instructions.

Likewise, there is a need to provide a receptacle that is pleasing in appearance. Receptacle must not detract from the appearance of the property at which it is installed. Indeed, there is a need for receptacles with an appearance that matches or fits with the overall appearance of the property. Moreover, there is a need for a receptacle which is strong enough to withstand severe impact and durable enough to last a long time. A significant factor in successful security measures is the impression that something will withstand breaking and entering attempts. A thief is more likely to target the less secure-looking, easier to break-into receptacle. Therefore, there is a need for a receptacle to convey a sense of strength, security and durability.

Finally, environmental concerns weigh heavily in today's society. Consumers are much more apt to adopt new products that are environmentally friendly. Consequently, there is a need for receptacles that are made of renewable materials. There is a need to minimize the environmental impact of the receptacles.

SUMMARY

An advantage of the embodiments described herein is that they overcome the disadvantages of the prior art. These advantages and others are achieved by a receptacle for secure mail and parcel receipt and storage. The receptacle includes a top which provides a roof for the receptacle, a base, and a housing connected to the top and the base. The housing includes an upper compartment into which mail is first placed, a lower compartment into which mail is deposited from the upper compartment, a front door, located on a front of the receptacle, which is opened to provide access to the upper compartment and through which mail is placed into the upper compartment, a trap door, operatively connected to the front door, in the upper compartment, and an access door that includes a lock. The trap door rests in an open position when the front door is closed, allowing communication between the upper and lower compartments. The trap door is moved to a closed position by the opening of the front door, thereby preventing access to the lower compartment from the upper compartment. The trap door returns to the open position when the front door is closed, depositing any mail placed in the upper compartment into the lower compartment. The access door is unlocked and opened to provide access to the lower compartment, whereby mail deposited and stored in the lower compartment may be retrieved through the access door.

DESCRIPTION OF THE DRAWINGS

The detailed description will refer to the following drawings, wherein like numerals refer to like elements, and wherein.

DETAILED DESCRIPTION

Described herein is an apparatus for secure postal and parcel receipt and storage. Embodiments of the apparatus provide a secure receptacle that is highly-resistant to theft and intentional or naturally-occurring damage. Embodiments may be used as a mailbox for securely receiving U.S. or other postal deliveries and/or as a receptacle for parcel packages delivered by delivery services such as UPS® or Federal Express®. Embodiments securely store the received postal or parcel deliveries until such time as the owner retrieves the deliveries. Embodiments may also be fabricated from environmentally-friendly materials such as recycled products.

Figure 1:
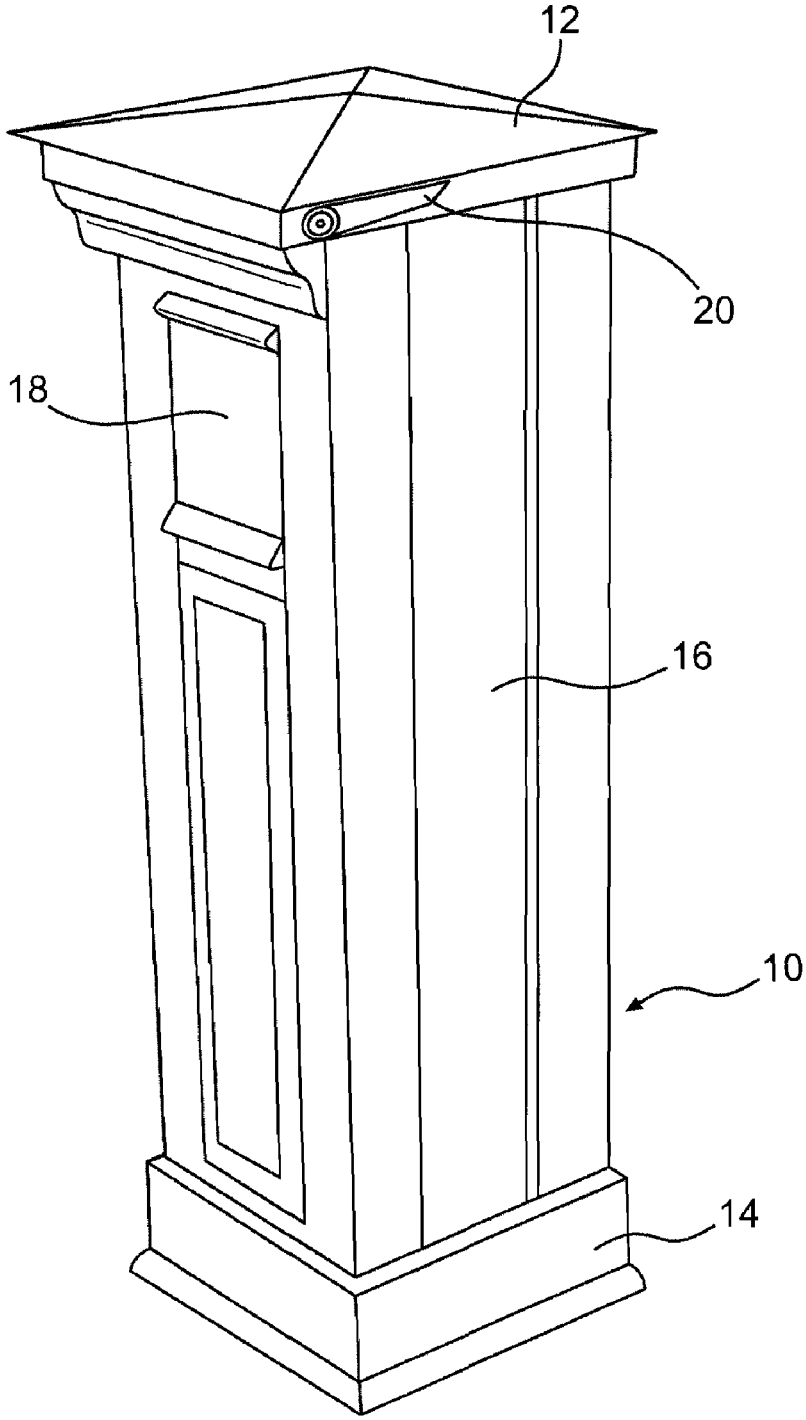
FIG. 1 is a diagram illustrating a perspective front view of an embodiment of an apparatus for secure postal and parcel receipt and storage.

With reference now to FIG. 1, shown is a perspective view of an embodiment of an apparatus for secure postal and parcel receipt and storage, secure receptacle 10. As shown, receptacle 10 includes a top 12, a base 14, and a housing 16 in between top 12 and base 14. Housing 16 includes a front, or receiving, door 18. Front door 18 is used by, for example, a postal delivery person to deposit mail in housing 16. Top 12 also includes a flag 20 for indicating that receptacle 10 contains mail for pick-up. As shown, receptacle 10 has square footprint with four-sided housing 16, top 12 and base 14. Although the square shape has been found to be best, other shapes, such as oblong rectangular or triangular may be used.

Receptacle 10 is shown as it would appear installed and in use. When installed, receptacle 10 is placed on the ground and may be secured to the ground with an anchoring system or device(s) (not shown in FIG. 1), as described in detail below. Other embodiments may be installed on a wall, for example an outer house wall near a front door, and secured to the wall through other means.

Figure 2C:
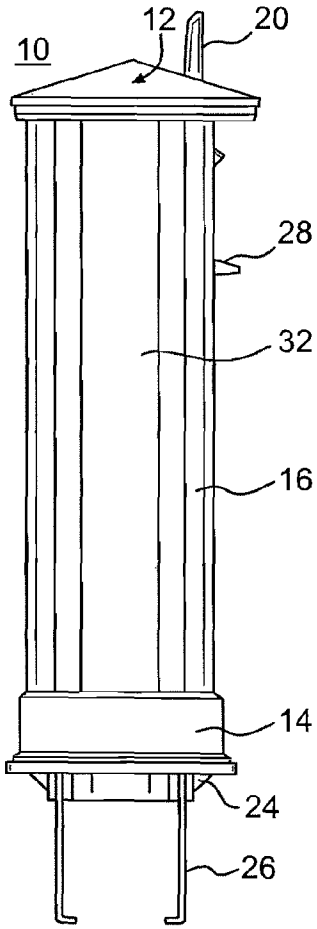
FIGS. 2A-2I are a series of side, front, rear, top and cross-sectional views of an embodiment of an apparatus for secure postal and parcel receipt and storage.
Figure 2B:
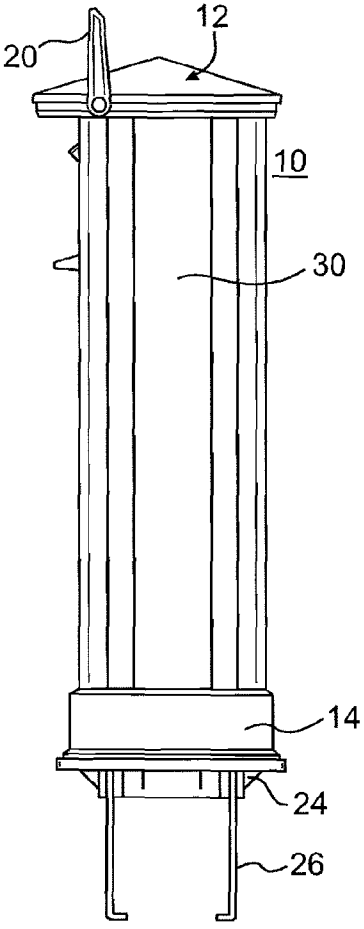
Figure 2A:
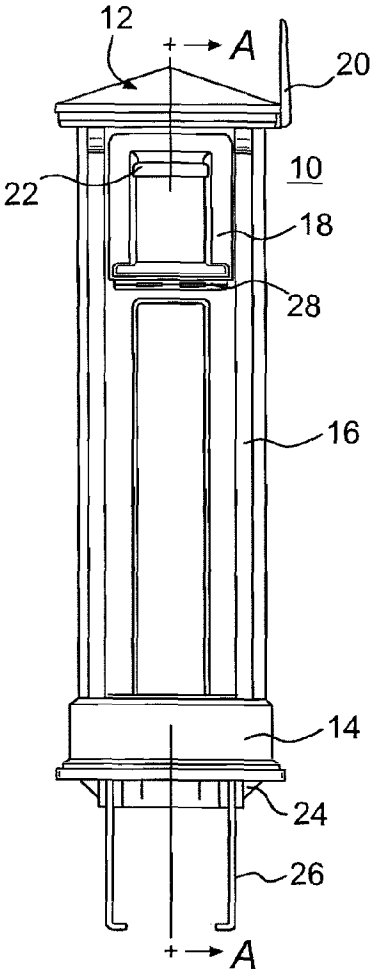

With reference now to FIGS. 2A-2I, shown are a variety of views that show an embodiment of secure receptacle 10 in greater detail. FIG. 2A is a front view of receptacle 10. As discussed above, receptacle 10 includes top 12, base 14 and housing 16. As shown, front door 18 in housing 16 includes handle 22 and stop 28. Stop 28 prevents front door 18 from over-rotating when opened. In the embodiment shown top 12 has a four-sided pyramid-shape. Such a shaped top 12 may be chosen to match its owner's house roof. Accordingly, receptacle 10 may include different shaped tops 12, e.g., chosen to match the house roof.

Seen in FIG. 2A is an embodiment of an anchoring system, a series of j-bolts or l-bolts 26 which extend through plate 24 and into base 14 and secure plate 24, base 14 and, therefore, receptacle 10, to the ground. In the embodiment shown, there are four j-bolts 26 that are placed into the ground when installing receptacle 10. In an embodiment, j-bolts 26 are placed into wet concrete poured into a hole in the ground and then surrounded with concrete that fills the hole. Plate 24 is placed onto j-bolts/l-bolts 26 and base 14 is affixed on plate 24 and bolts 26. Anchored as such, j-bolts 26 stably and rigidly fixes receptacle 10 to the ground. While j-bolts 26 strongly secure plate 24, and hence receptacle 10, to ground, design of base 14 will cause base 14 (and, hence, receptacle 10) to breakaway from plate 24 and j-bolts 26 if struck with a strong enough force (e.g., a car). This helps to prevent receptacle 10 from causing serious damage to vehicle if struck.

Figure 2D:
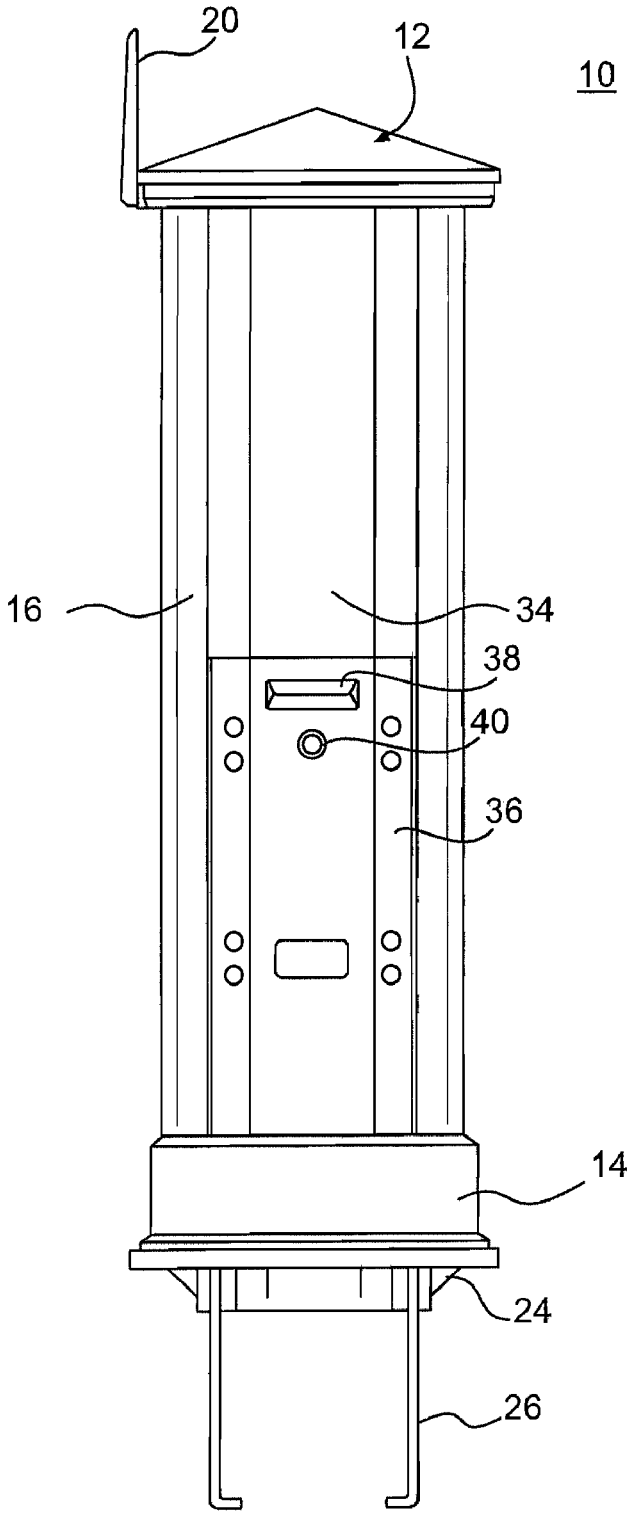

With reference now to FIGS. 2B-2D, shown are two side views and a rear view, respectively, of an embodiment of receptacle 10. Right side 30 of receptacle 10 is shown in FIG. 2B while left side 32 of receptacle 10 is shown in FIG. 2C. As shown in FIG. 2B, flag 20 may be rotatably attached to a side of top 12. Flag 20 is rotated counter-clockwise from the horizontal position shown to a vertical position to indicate the receptacle 10 contains mail for pick-up. Postal carrier then rotates flag 20 clockwise back to horizontal position upon retrieving mail for pick-up. Also shown in both FIGS. 2B and 2C is a side-view of stop 28 on front door 18. As shown, stop 28 extends perpendicularly away from front door 18 and acts to help prevent front door 18 from over-rotating when opened, which is described below. Two j-bolts 26 are also shown in FIG. 2C.

With continuing reference to FIGS. 2B and 2C, in the embodiment shown, right side 30 and left side 32 of receptacle 10 each include two side panels. The sides of receptacle 10 may each include one panel for the entire side or multiple panels. Indeed, other panels shown in the views of receptacle 10 herein may be substituted by multiple panels.

As shown in FIG. 2D, rear 34 of receptacle 10 includes access door 36. Access door 36 provides access to lower compartment, or vault portion, (not shown in FIG. 2D) of housing 16. Access door 36 is akin to a bank vault door. When mail or a parcel is received through receiving door 18 it is deposited in the lower compartment, or vault, of housing 16. In an embodiment, access door 36 may pivot open, at the bottom of access door 36, or may simply be removed, as discussed below. Access door 36 includes a lock so that access door 36 may be locked to secure access to the vault. As shown, access door 36 includes a handle 38 and a keyhole 40. Access door 36 and lock of access door 36 are discussed in more detail below.

Figure 2E:
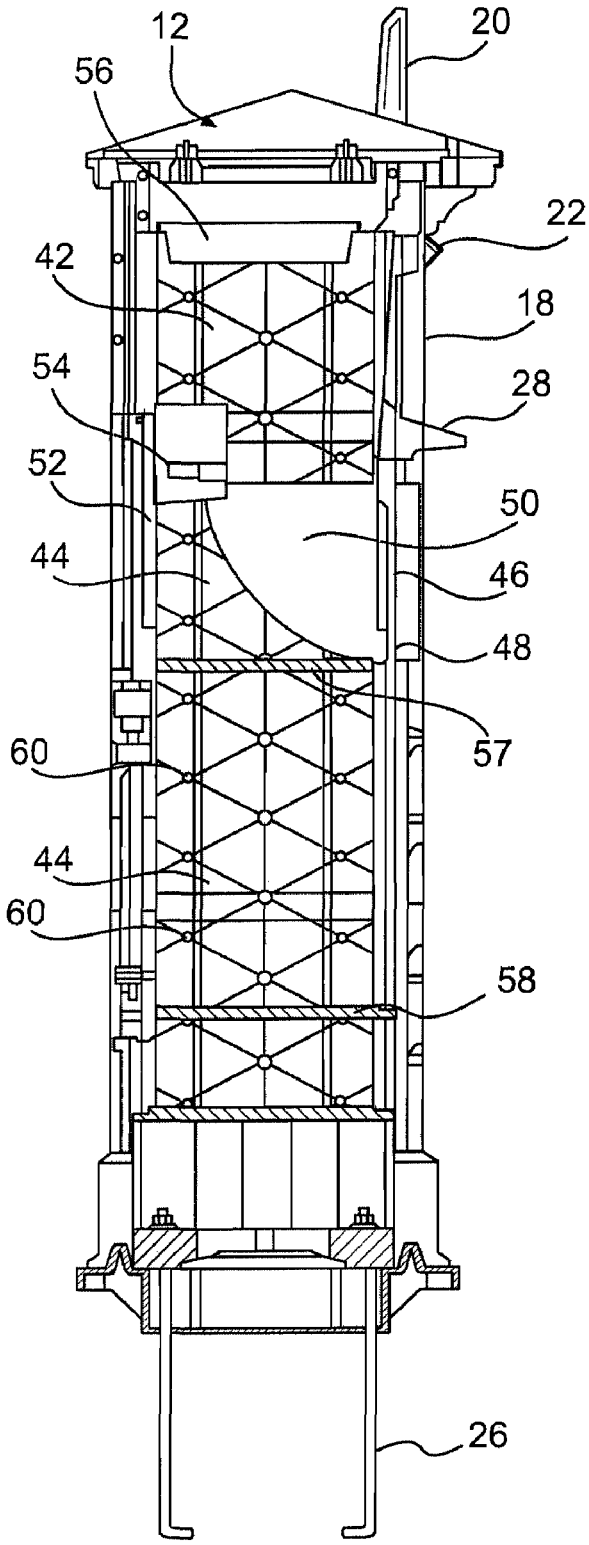

With reference now to FIG. 2E, shown is a cross-sectional side view of receptacle 10. This view illustrates the interior of housing 16, showing upper compartment 42 and lower compartment 44. Upper compartment 42 is located behind front door 18 and beneath top 12. When front door 18 is closed, as shown in FIG. 2E, upper compartment 42 does not have a floor and is open to lower compartment 44. Front door 18 includes an extension, front door extension 46, that pivots to form part upper compartment 42 floor when front door 18 is open. In an embodiment, front door extension 46 includes a plurality of fingers (see below). When front door 18 is closed, front door extension 46 is positioned against front inside wall 48 of housing 16, as shown in FIG. 2E.

In addition to front door extension 46, front door 18 also includes cam plate 50. Cam plate 50 is attached to front door extension 46 and is positioned along interior of right side 30 of housing 16. When front door 18 is closed, cam plate 50 is positioned in lower compartment 44 in its "lower position", as shown in FIG. 2E. In this position, as shown, the leading, upper edge of cam plate 50 is positioned adjacent to trap door extension 54. Trap door 52 is shown in its "open position." Accordingly, when front door 18 is opened, cam plate 50 rotates upwards through or past trap door extension 54 and into upper compartment 42, into its "upper position," causing trap door 52 to pivot on its hinge upwards to trap door 52 "closed position." This is illustrated in FIG. 2F.

Figure 2F:
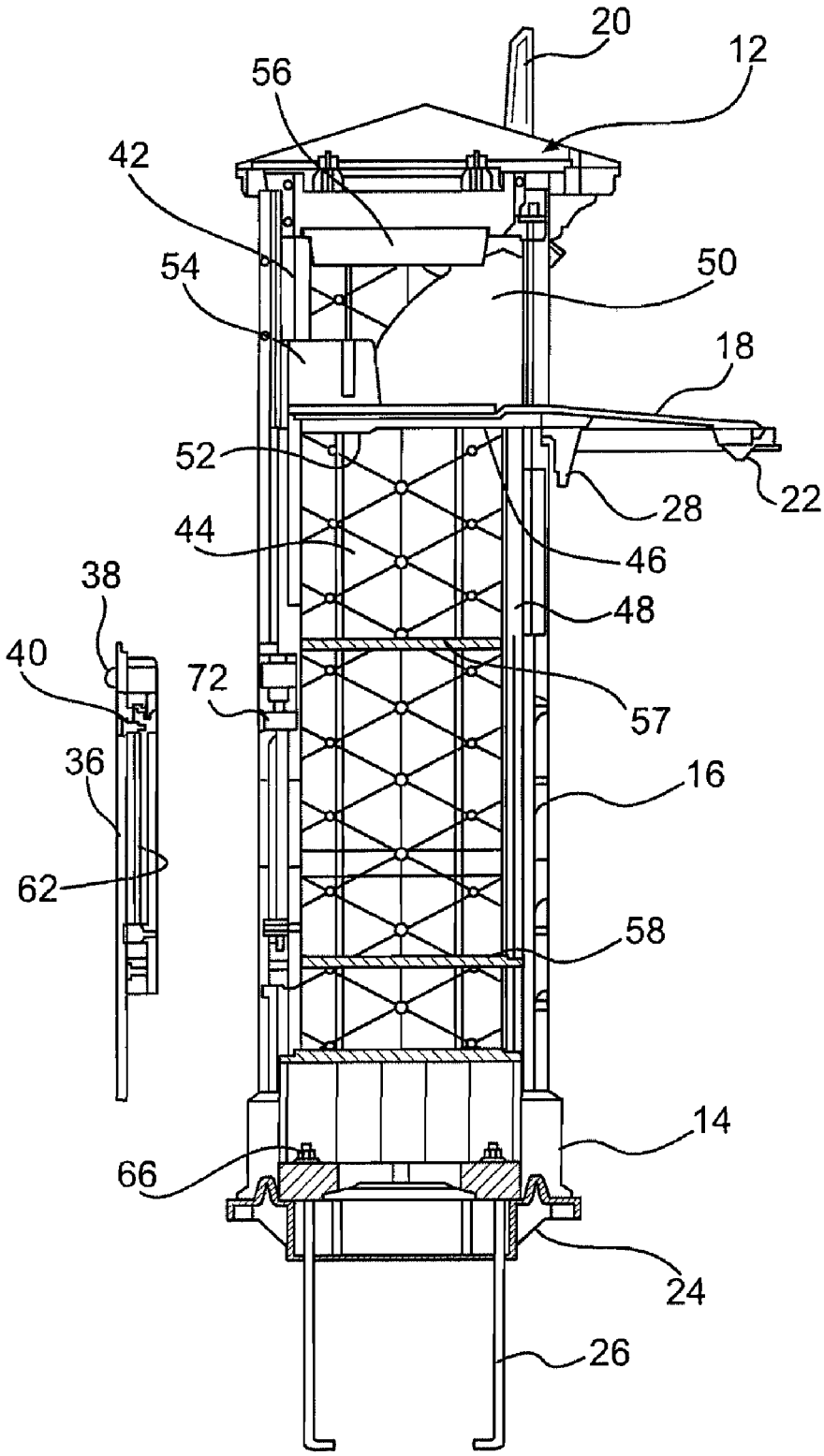

As shown in FIG. 2F, when front door 18 is opened, trap door 52 is rotated to its closed position and forms, together with front door extension 46 which has pivoted upwards, floor of upper compartment 42. Front door extension 46 fits under trap door 52, thereby supporting trap door 52. In this manner, front door 18 acts as a counter-weight, with hinge between front door 18 and front door extension 46 acting as pivot point, to trap door 52 and any mail or parcels placed upon it. Trap door 52, along with front door extension 46, therefore, provides a sturdy shelf on which to place items (e.g., mail or parcels) when front door 18 is opened. Upper compartment 42 also includes outgoing mail shelf 56, on which outgoing mail is placed. In an embodiment, receptacle 10 may include a cam, or other mechanism, that forces flag 20 into raised position when mail is placed on outgoing mail shelf 56. After placing mail or parcels on floor of upper compartment 42, postal or other delivery person may remove outgoing mail from outgoing mail shelf 56 and closed front door 18.

With reference again to FIG. 2E, lower compartment, or vault, 44 is located below floor of upper compartment 42 formed when front door 18 is opened as described above. By forming floor of upper compartment 42 as described above, trap door 52 and front door extension 46 provide a temporary surface on which mail or parcels may be placed while also closing off and preventing access to lower compartment 44. In this manner, lower compartment 44, and any mail or parcels it may contain, are secured.

Lower compartment 44 includes an upper shelf 57 and a lower shelf/base cover 58. Lower shelf/base cover 58 serves to cover base 12. Upper shelf 57 is adjustable and may be raised or lowered, using a series of shelf support pins and support pinholes 60. Alternatively, upper shelf 57 may be supported by a spring-loaded, or other biased, mechanism. As mail or parcels are placed on upper shelf 57, the weight causes upper shelf 57 to lower. When mail and/or parcels are placed on trap door 52 and front door 18 is closed, front door extension 46 and cam plate 50 pivot and rotate downwards into lower compartment 44 causing trap door 52 to pivot open, dropping mail and/or parcels into lower compartment 44. The mail and/or parcels are deposited on upper shelf 57 in lower compartment 44 and are stored there until retrieved via access door 36.

The lower the upper shelf 57 is set in lower compartment 44, the greater the capacity for mail and/or parcels lower compartment 44, and hence receptacle 10, will have. The owner of secure receptacle 10 may set the upper shelf 57 height, and hence receptacle 10 capacity, based on expected amount of mail storage capacity needed. Ordinarily, if highest setting provides sufficient storage for one day's mail and/or parcels, owner would set upper shelf 57 at highest height. If, however, owner expected to be unable to retrieve mails for days, or expected to receive an extraordinary amount of mail/parcels, the owner would set upper shelf 57 at a lower height. By enabling the storage capacity of receptacle 10 to be increased, receptacle 10 may securely receive and store multiple days of mail and/or parcels. In this manner, receptacle 10 may enable owner to travel without the hassle of making alternative arrangements for mail/parcel delivery or pickup or worrying about mail/parcels piling up in an un-secure mailbox. If lower compartment 44 is filled with mail and/or parcels above upper shelf 57, i.e., lower compartment 44 is filled to capacity, then trap door 52 (and front door extension 46) may be prevented from pivoting into its closed position, thereby preventing, due to cam plate 50, front door 18 from opening. If confronted with a receptacle 10 that will not open, postal delivery person will be forced to hold mail at post office. Consequently, receptacle 10 may securely store a large amount of mail and/or parcels and prevents mail and/or parcels from piling up in open, un-secure compartment as in traditional mail-boxes.

With continuing reference to FIG. 2E, cross-sectional side view of access door 36 is shown. As seen, top of access door 36 extends above highest position of upper shelf 56. Consequently, owner may access mail and/or parcels on upper shelf 56 when it is in highest position (i.e., typical one day's mail and/or parcels) without fully opening access door 36. Handle 38 and cross-section of keyhole 40 may be seen in this view. A portion of lock mechanism 62 which is activated and deactivated with key inserted in keyhole 40, may also be seen.

A cross-section of base 14 is also seen in FIG. 2E. As shown, j-bolt 26 is inserted through hole (not shown) in plate 24 and secured to plate 24 with nut 66 and washer 68. Plate 24 of base typically extends into the ground on which receptacle 10 is mounted. J-bolts 26 extend through plate 24 into base 14. Base 14 may be affixed or secured to plate 24 and j-bolts 26 by tightly fitting around rubber washers/sleeves 67, as shown below. The base 14 is also shown to extend into lower portion of housing 16, providing increased stability and strength.

With reference now to FIG. 2F, shown is a cross-sectional side view of an embodiment of secure receptacle 10 with the front door 18 open and access door 36 removed. In typical use of receptacle 10, front door 18 and access door 36 would not be open simultaneously. Access door 36 is typically kept closed when mail is delivered, i.e., when front door is opened, and is usually opened at a later time when owner retrieves previously delivered mail and/or parcels stored in receptacle 10. Nonetheless, FIG. 2F serves to illustrate receptacle 10 and the operation of receptacle 10.

With reference to the upper compartment 42, front door 18 is shown to be completely opened, in a substantially horizontal position parallel to the ground (slope of top surface of door may be slightly below horizontal (e.g., 5 to 10 degrees below horizontal). Stop 28 is resting against front of receptacle 10 and front door extension 46 is also in a horizontal position, parallel to the ground, directly underneath trap door 52. Because of the movement, into this horizontal position, of front door extension 46, to which cam plate 50 is attached, cam plate 50 has rotated into its upper position, causing trap door 52 to pivot into its closed position, as shown in FIG. 2F. As discussed above, trap door 52 and front door extension 46, in these respective positions, form a temporary floor of the upper compartment 42. Mail, parcels, etc. may be placed on this floor, on which such mail, parcels, etc. will rest until front door 18 is closed. Likewise, with front door 18 opened as shown, any outgoing mail in upper shelf 56 may be removed.

Figure 2I:
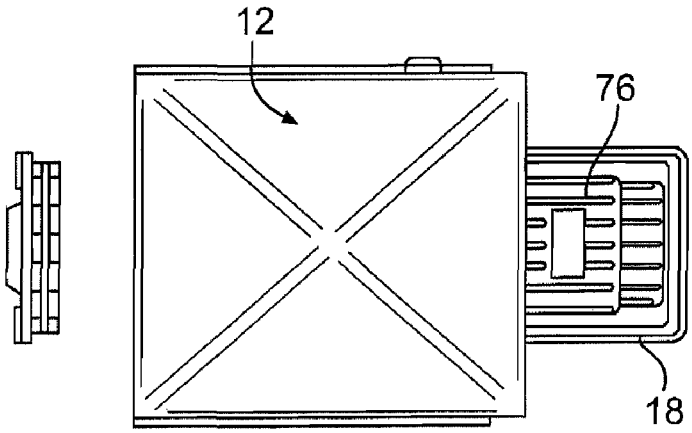
Figure 2G:
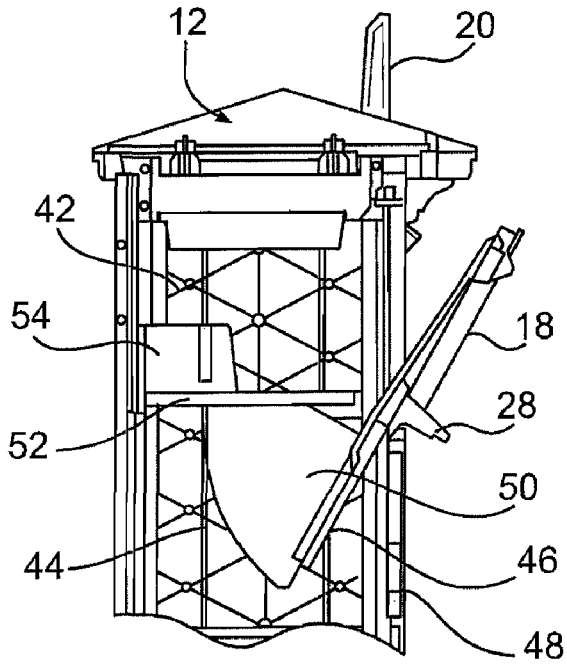

With reference now to FIG. 2G, when front door 18 is being closed, front door extension 46 and attached cam plate 50 pivot and rotate towards the lower position until front door extension 46 rests against front inside wall 48. FIG. 2G is a cross-sectional side view of top portion of receptacle 10, showing upper compartment 42 when front door 18 is partially closed. When front door 18 is being closed, trailing, upper edge of cam plate 50 rotates downward through or past trap door extension 54 and towards trap door 52, as shown. As trailing, upper edge of cam plate 50 rotates through or past trap door extension 54 and past trap door 52, it causes trap door 52 to pivot open until trap door 52 is at rest in its "open position" (e.g., shown in FIG. 2E). As shown, however, this design feature causes trap door 52 to remain in closed position until front door 18 is almost completely closed.

Similarly, FIG. 2G also serves to illustrate front door 18 is in process of being opened. When being opened, upper edge of cam plate 50 is the leading rather than trailing edge of cam plate 50. As leading edge, upper edge of cam plate 50 causes trap door 52 to pivot into closed position ahead of front door extension 46 and before front door 18 is completely opened (indeed, trap door 52 pivots into closed position immediately as front door 18 starts to open). The cooperative features of trap door 52 remaining in closed position until front door 18 is almost completely closed and moving to closed position immediately as soon as front door 18 begins to open serves at least two important purposes: first, because trap door 52 almost completely covers opening between upper compartment 42 and lower compartment 44, a thief will be prevented from reaching lower compartment 44 even when front door 18 is barely opened as trap door 52 will be in closed position, almost completely covering lower compartment 44; and, second, if delivery person only partially opens front door 18 to place mail into upper compartment 42, e.g., to prevent rain from entering receptacle 10, trap door 52 will be in closed position and the mail will still temporarily rest on trap door 52 before trap door 52 opens and deposits mail into lower compartment 44, preventing mail from becoming caught up or otherwise damaged in moving parts of receptacle 10. Consequently, these features of the trap door 52 operation serve to valuably increase the security and every-day performance of receptacle 10.

Returning to FIG. 2F, and specifically the lower portion of receptacle 10, cross-section of access door 36 is shown. As described above, access door 36 may be partially opened (e.g., by being pivoted on its bottom edge) or may be removed entirely. Access door 36 is shown removed from receptacle 10. Removing access door 36 may be useful, for example, if lower compartment 44 is filled with mail, parcels, etc. (e.g., upper shelf 56 is in lowest position and a week of mail is deposited on it). If access door 36 is so removed, person removing mail, parcels, etc. will have greater and easier access to lower compartment 44. Once mail, parcels, etc. is removed from lower compartment 44, access door 36 may be placed back in receptacle 10.

In the view shown, upper shelf 56 is in its highest position. Any deposited mail, parcels, etc. would be resting on upper shelf 56 and may be removed with access door 36 open.

With continuing reference to FIG. 2F, there may be lock bolt or pin holes (not shown) for access door 36 lock mechanism 62. As is discussed below, lock mechanism 62 includes a series of bolts or pins, akin to vault or dead bolts, that extend into lock bolt holes when access door 36 is closed and locked. Alternatively, receptacle 10 may be fabricated with a rail or track in place of lock bolt holes, so that lock mechanism 62 bolts or pins simply extend behind rail 72, catching on rail to prevent access door 36 from being opened. The rail is simpler to mold then bolt holes, making the fabrication of receptacle 10 easier. Consequently, lock mechanism 62 and lock bolt holes 72 cooperate to keep access door 36 secured to receptacle 10 when closed and locked.

Figure 2H:
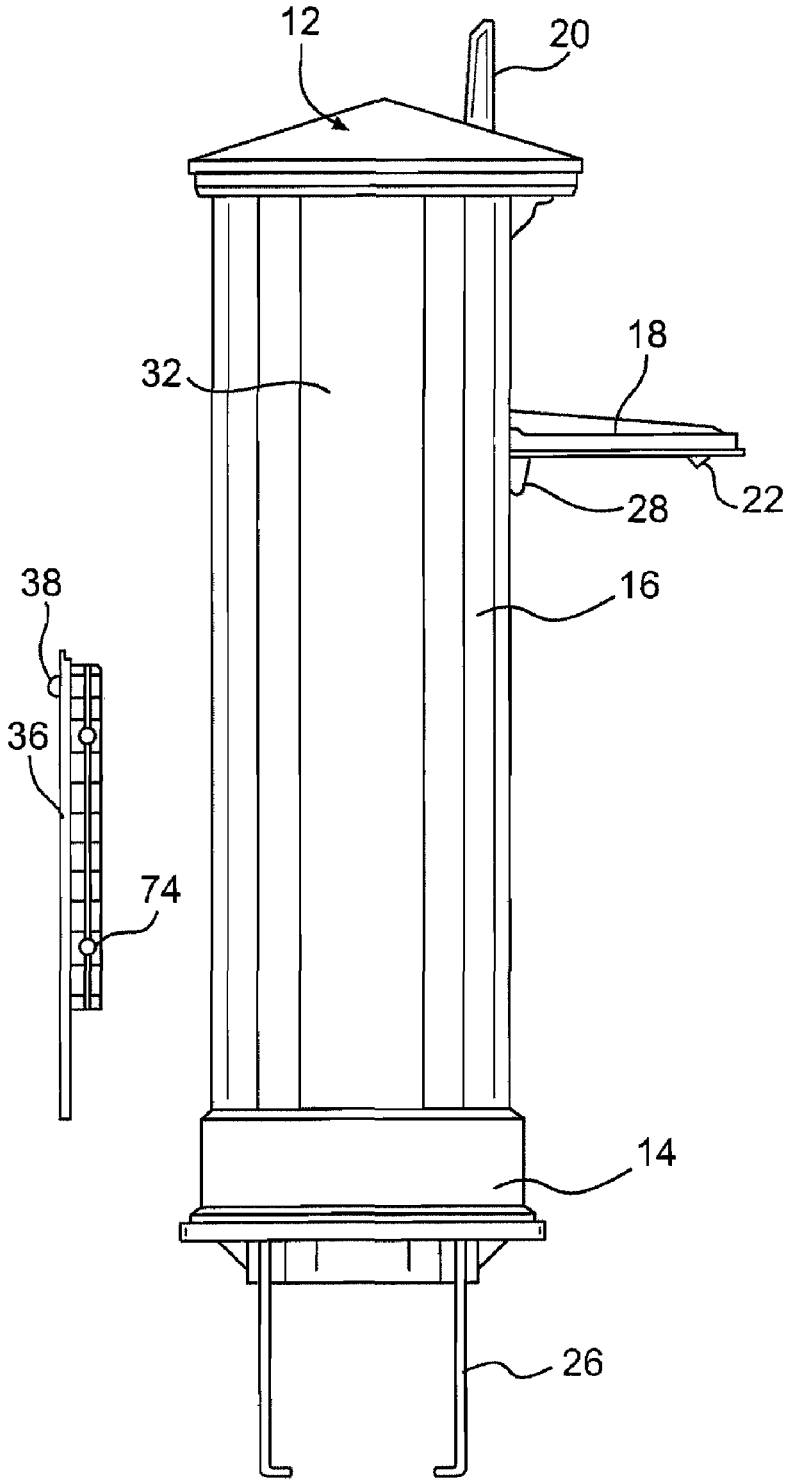

With reference now to FIG. 2H, shown is a side view of an embodiment of receptacle 10 showing left side 32 with access door 36 removed. The view shown corresponds to the cross-sectional view shown in FIG. 2F. Side view of open access door 36 can be seen, with ends of two of lock bolts or pins 74 of lock mechanism 62 visible.

With reference now to FIG. 2I, shown is a top view of an embodiment of receptacle 10 with access door 36 removed and front door 18 open. Grooved surface 76 of front door 18 can also be seen. Grooved surface 76 serves to wick away excess moisture from mail, parcels, etc. as they are slid into upper compartment 42.

Figure 3:
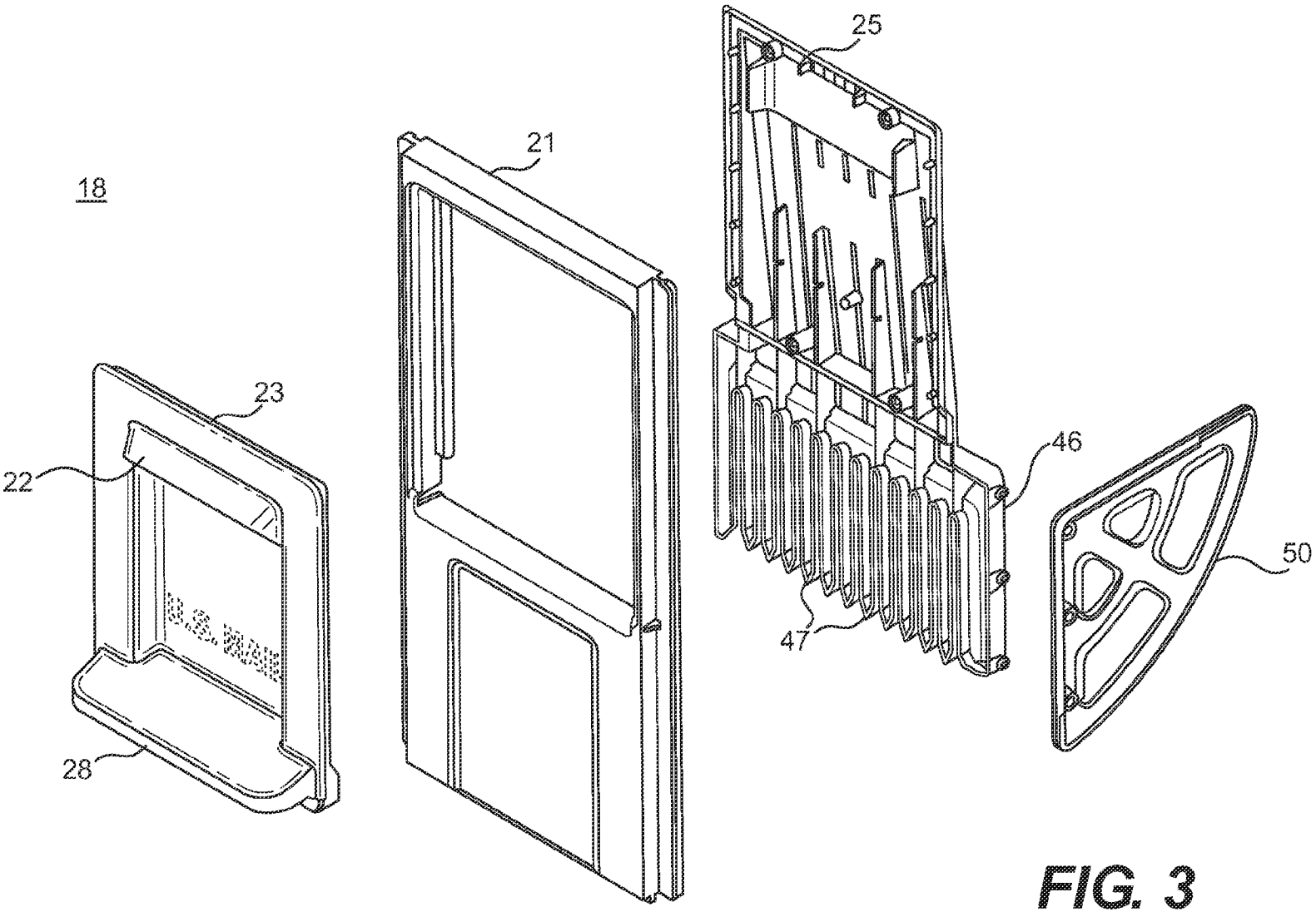
FIG. 3 is front perspective views of a front door of an embodiment of an apparatus for secure postal and parcel receipt and storage.

With reference now to FIG. 3, shown is a perspective exploded view of an embodiment of front door 18. Front door 18 includes front door frame 21, front piece 23 and rear piece 25 with front door extension 46. Front piece 23 includes handle 22 and stop 28. Front door 18 assembled as two-pieces with front door rear piece 25 providing front door extension 46. In an embodiment, front door extension 46 includes a plurality of fingers 47. Fingers 47 act as a further security feature of receptacle 10; e.g., fingers 47 prevent flexible means or devices (e.g., fishing line, string, VCR tape, double-sided or masking tape, etc.), that thieves commonly use, from accessing vault 44. The space between the fingers 47 traps or catches such flexible devices and prevents, or makes difficult, mail or parcels from being retrieved from vault 44. Fingers 47 also fit under trap door 52, supporting it. As also shown here, fingers 47 may extend wider then front door 18 because interior of upper compartment 42 is wider than opening for front door 18. Fingers 47, therefore, fill nearly entire width of upper compartment 42 for the length of front door extension 46. This minimizes or eliminates any gaps that would enable access to lower compartment 44. Front door extension 46 may be formed as one piece with front door 18 or separately formed and attached to front door 18. Attached to front door extension 41 is cam.

Figure 4A:
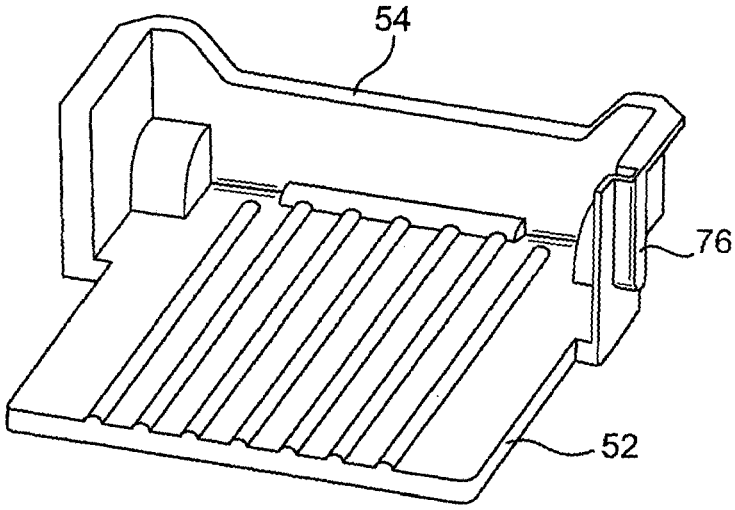
FIGS. 4A-4B are top and bottom perspective views of a trap door of an embodiment of an apparatus for secure postal and parcel receipt and storage.
Figure 4B:
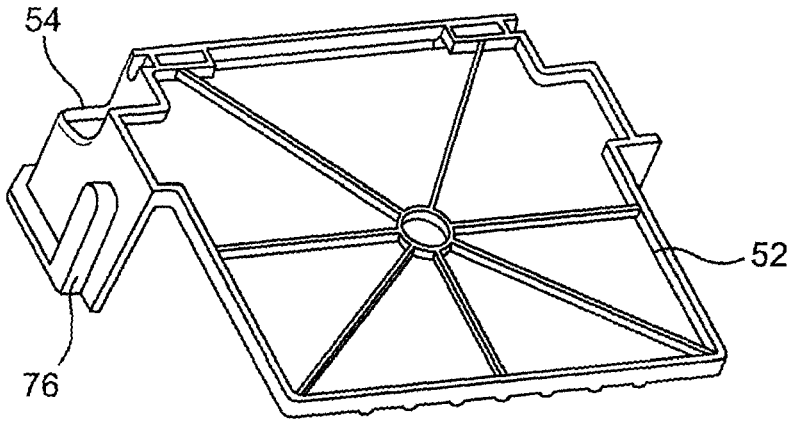

With reference now to FIGS. 4A and 4B, shown are perspective top and bottom views of an embodiment of trap door 52. As discussed above, trap door 52, when in closed position, extends to cover almost entire "bottom" of upper compartment 42. Accordingly, trap door 52 is width or nearly the width of the interior of upper compartment 42, similar to front door extension 46, (the trap door 52 and front door extension 46 width may provide a slight gap to accommodate different positions of panels—see below). Trap door 52 may also include ridges or grooves on top surface, as shown. Trap door 52 also includes trap door extension 54, as discussed above. Trap door extension 54 includes catch 76 on its right side. Catch 76 is in contact with cam plate 50 and enables cam plate 50 to cause trap door 52 to pivot from open to closed positions, and vice-versa, as front door 18 is opened and closed, as discussed above. Catch 76 and cam plate 50 may be on left side of trap door extension 54 in an alternative embodiment. Trap door extension 54 may be formed as one piece with trap door 52 or separately formed and attached to trap door 52.

Figure 5A:
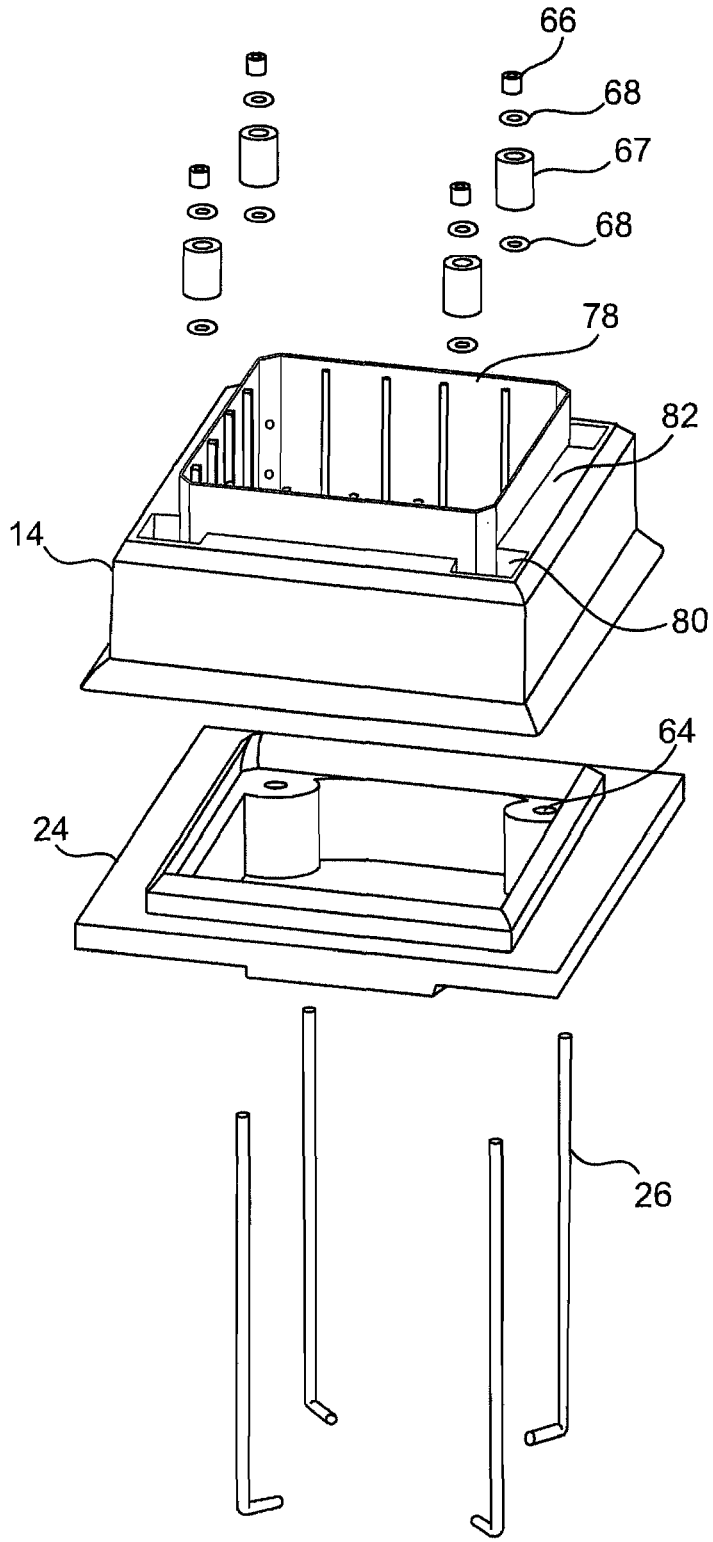
FIGS. 5A-5B are top and cross-sectional perspective views of a base of an embodiment of an apparatus for secure postal and parcel receipt and storage.
Figure 5B:
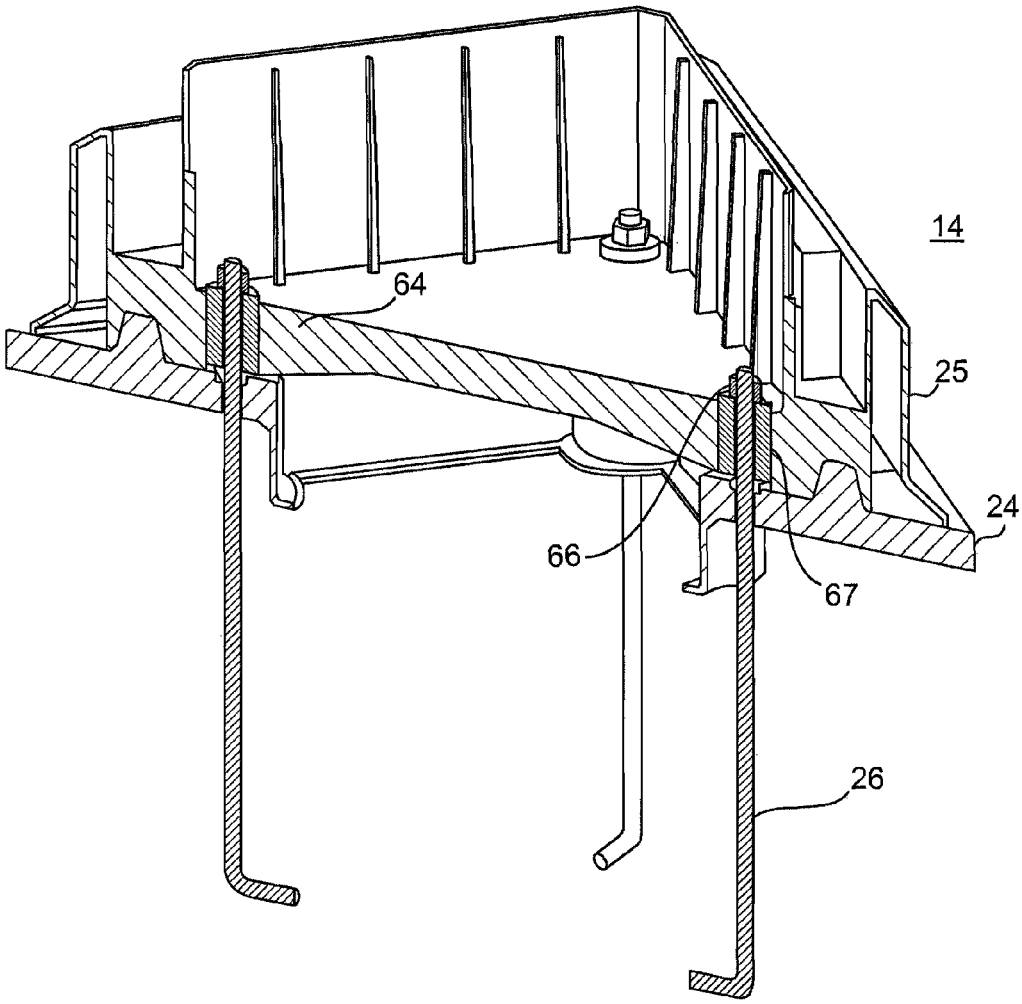

With reference now to FIGS. 5A and 5B, shown are perspective top and bottom views of an embodiment of base 14 and plate 24. As shown here, bottom or base portion of receptacle 10 includes base 14 and plate 24. Base 14 and plate 24 are assembled together to form bottom or base portion of receptacle 10 when receptacle 10 is installed. As shown here, both plate 24 and base 14 also includes holes 64, into which j-bolts 26 extend, cavity 78, into which bottom edge or portion of access door 36 extends, corner post holes 80 and housing panel ledges 82, onto which housing panels are placed when receptacle 10 is assembled (see below). In an embodiment, holes 64 extend from plate 24 into base 14; in plate 24, holes 64 are sized to fit over ends of j-bolts 26 extending up from ground, while in base 14, holes 64 are sized to fit snugly over rubber washer/sleeves 67. Holes 64 and j-bolts 26 include a pinch feature; specifically, holes 64 and j-bolts 26 are designed so that j-bolts 26 may be inserted into holes 64 in plate 24 and turned until pinched (e.g., 90 degrees) by holes 64 and held in place. Base 14 and plate 24 may be formed as one piece or separately formed as multiple components and assembled.

To install an embodiment of receptacle 10, a hole may be dug in the ground. The hole is preferably deep and wide enough to sufficiently anchor receptacle 10 when filled with cement. For example, the hole may be approximately twenty-four inches (24") deep and sixteen inches (16") in diameter. A cardboard template may be provided with receptacle 10 to mark the hole size. Plate 24, with j-bolts 26 installed in holes 64, is then set on the ground above the hole and leveled. Cement or concrete is poured into hole. J-bolts 26 are sunk into cement. More cement is poured into hole (through opening in bottom portion 24) until some of plate 24 is trapped in cement. Optionally, re-bar may be put into cement in hole. After cement is hardened, base 14 is placed on plate 24, with ends of j-bolts 26 sticking up through portion of holes 64 in base 14. Washers 68, rubber sleeves/washer 67 and nuts 66 are threaded onto j-bolts 26 to secure base 14 to bottom portion 24. With reference to FIG. 5B, cross-sectional view of base 14 shows j-bolts 26, secured with washers 68, rubber sleeves/washers 67 and nuts 66 in portion of holes 64 extending into base 14. Rubber sleeves 67 expand in holes 64 when nuts 66 are tightened on them. Tight fit of holes 64 in base 14 around expanded rubber sleeves 67 secures or affixes base 14 to plate 24 and j-bolts 26.

This manner of securing base 14 to plate 24 and j-bolts 26 also provides break-away feature of receptacle 10. Base 14 secured as described herein will provide solid foundation for receptacle 10, enabling it to stay upright in strong winds, snow or other elements. However, because base 14 is secured only through tight fit of rubber sleeves 67, and not otherwise fastened to plate 24 or j-bolts 67, and because j-bolts 26 only extend a small amount into base 14 (see, e.g., FIG. 2E) base 14, and hence receptacle 10, will break-away from plate 24 and j-bolts 26 if struck by sufficient force. This feature decreases damage to vehicle or other object striking receptacle 10.

Figure 6C:
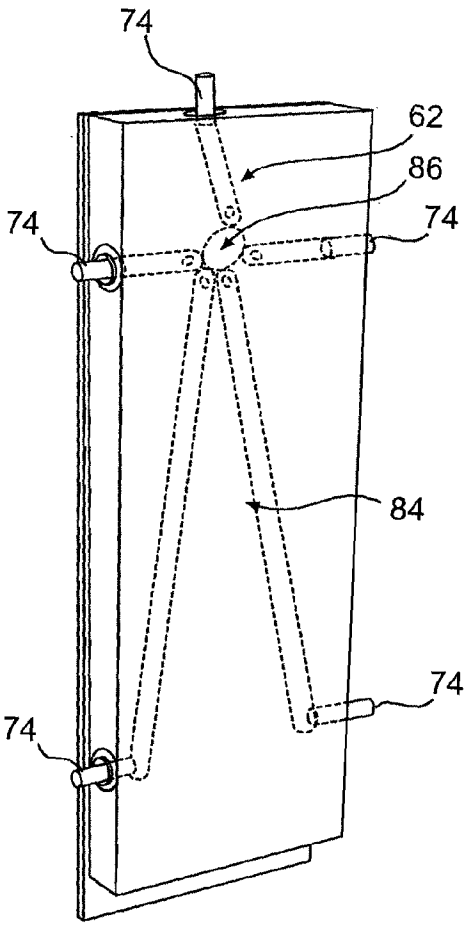
FIGS. 6A-6C are front and cross-sectional rear perspective views of an access door of an embodiment of an apparatus for secure postal and parcel receipt and storage.
Figure 6B:
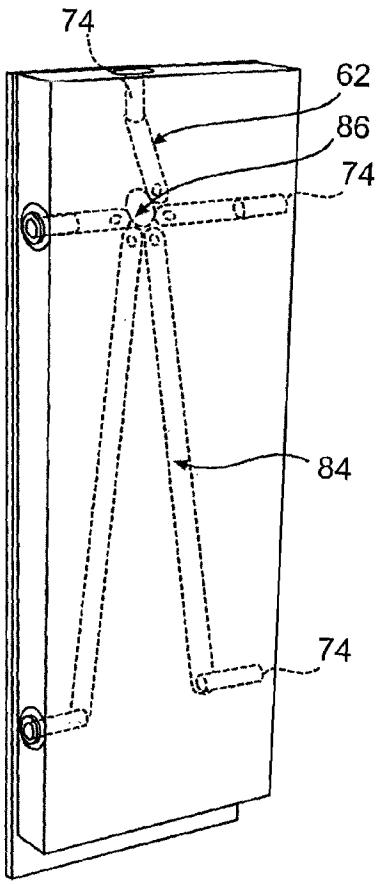
Figure 6A:
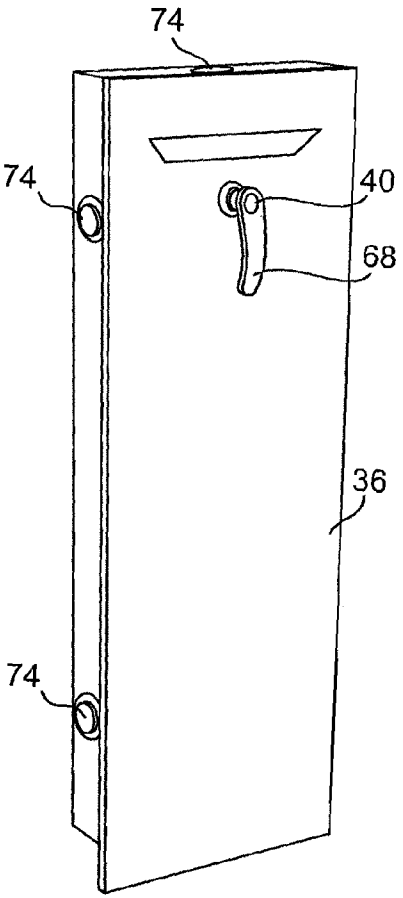

With reference now to FIGS. 6A-6C, shown are perspective front and cross-sectional rear views of an embodiment of access door 36. With reference to FIG. 6A, in the embodiment shown, access door handle 38 and keyhole 40 have been combined. Lock bolts 74 of lock mechanism 62 are also seen. FIGS. 6B and 6C illustrate an embodiment of lock mechanism 62. In the embodiment shown, lock mechanism 62 is a high-strength toggle lock mechanism. As such, lock mechanism 62 includes three-five toggle arms 84 connecting a rotating toggle plate 86 to five lock bolts or pins 74. As can be seen, access door 36 has sufficient thickness to accommodate lock mechanism 62, particularly lock bolts 74. In the embodiment shown, lock bolts 74 are round cylinders. Round cylinders provide a good locking mechanism, although flat or other shaped lock bolts 74 may be used. Between the thickness of access door 36 and the cylindrical, large diameter lock bolts 74, access door 36 has a high resistance to being pried open.

In the cross-section shown in FIG. 6B, toggle lock mechanism 62 is in open position; key is in keyhole 40 (not shown) and rotated clockwise (from view-point from front of access door 36) into unlocked position, retracting lock bolts 74 into recessed positions in access door 36. In the cross-section shown in FIG. 6C, keyhole 40 has been rotated clockwise (from view-point from front of access door 36) into locked position, as shown by arrows, extending lock bolts 74 into lock bolt holes 72 (not shown) in housing 16. In an embodiment, lock bolts 74 and lock mechanism 62 may be fabricated from plastic or other similar materials. Lock bolts 74 and lock mechanism 62 may be fabricated from other high-strength material, such as steel, etc. This increases strength of access door 36 and its resistance to entry by prying or other means. Accordingly, lock mechanism 62 may provide a high-strength, five-point locking system that secures lower compartment 44 and receptacle 10, minimizing theft. Importantly, in the embodiment shown, one key operates this five-point locking system.

One of the many features of embodiments described herein is that receptacle 10 is a modular design. The modular design provides receptacle 10 and its users with a great degree of functional and appearance flexibility. For example, receptacle 10 may have different heights, widths and other dimensions. Receptacle 10 may be assembled into different shapes (e.g., rectangle, pentagon, circle, etc.). Likewise, a plurality of receptacles 10 may be assembled together, side-by-side (in side-by-side assembly, there are configuration changes to base, roof and extrusions). Different panels (e.g., left and right side panels 94, lower front panel 100, intermediate front panel 102, upper rear panel 104—see FIG. 7) may be used, whether for providing the different heights, widths, other dimensions and shapes, for decorative or other appearance-related purposes, for replacing worn-out or damages existing panels, or for other purposes. These and other features of the modular design of receptacle 10 are described below.

With reference now to FIGS. 7A-7D, shown are exploded views of an embodiment of secure receptacle 10. The exploded views illustrate various components of an embodiment of receptacle 10 that may be assembled to assemble and install receptacle 10 (omitted are most of the connectors or fasteners that may be used to connect and fasten the components shown together; such connectors and fasteners are known and one of ordinary skill in the art would be able to select such connectors and fasteners without undue experimentation). The various components illustrated include panels and other components that provide the modular design of receptacle 10 discussed above. Specifically, shown are main components of top 12, base 14, and housing 16.

Figure 7A:
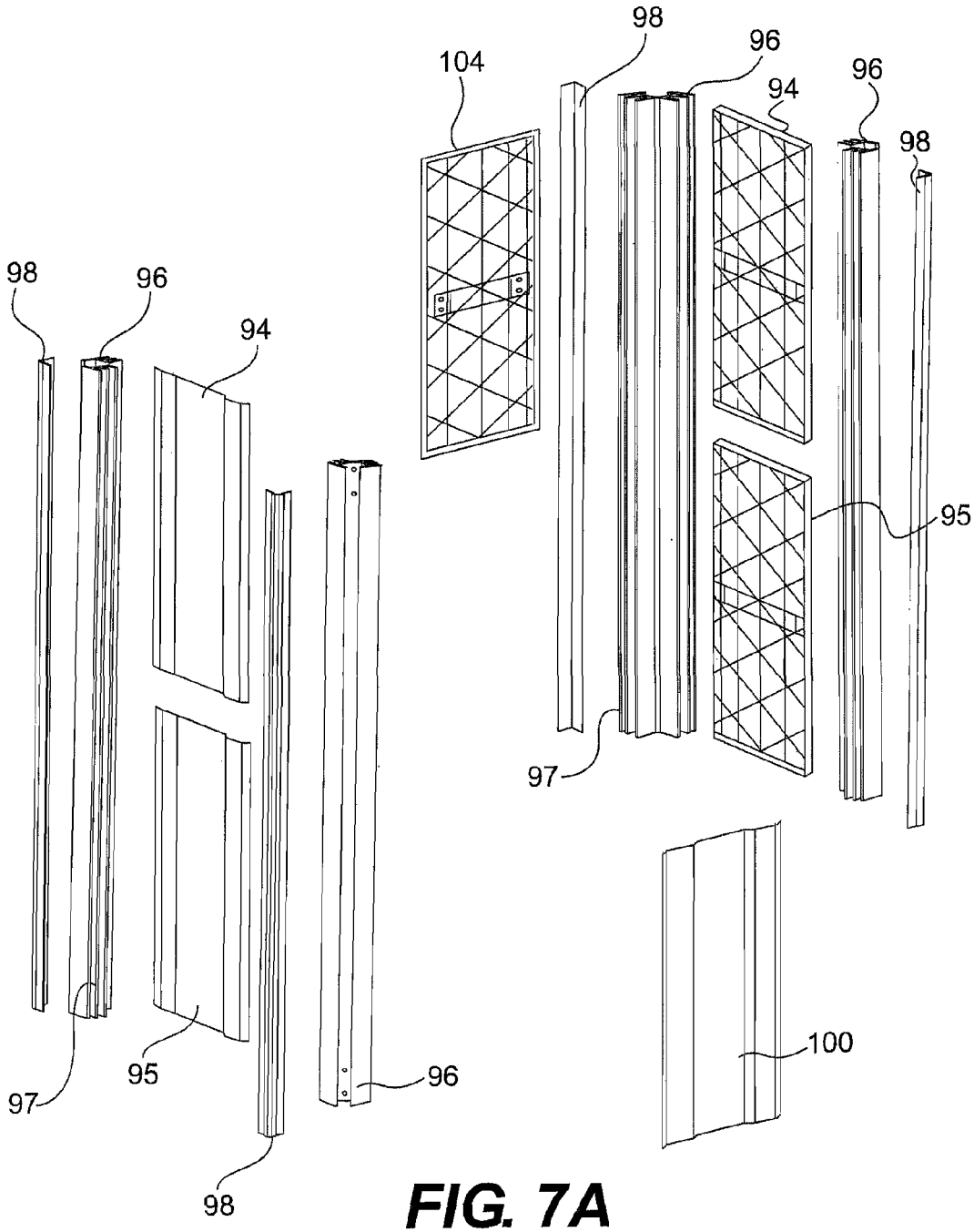
FIGS. 7A-7D are exploded views of various components of an embodiment of an apparatus for secure postal and parcel receipt and storage.
Figure 7B:
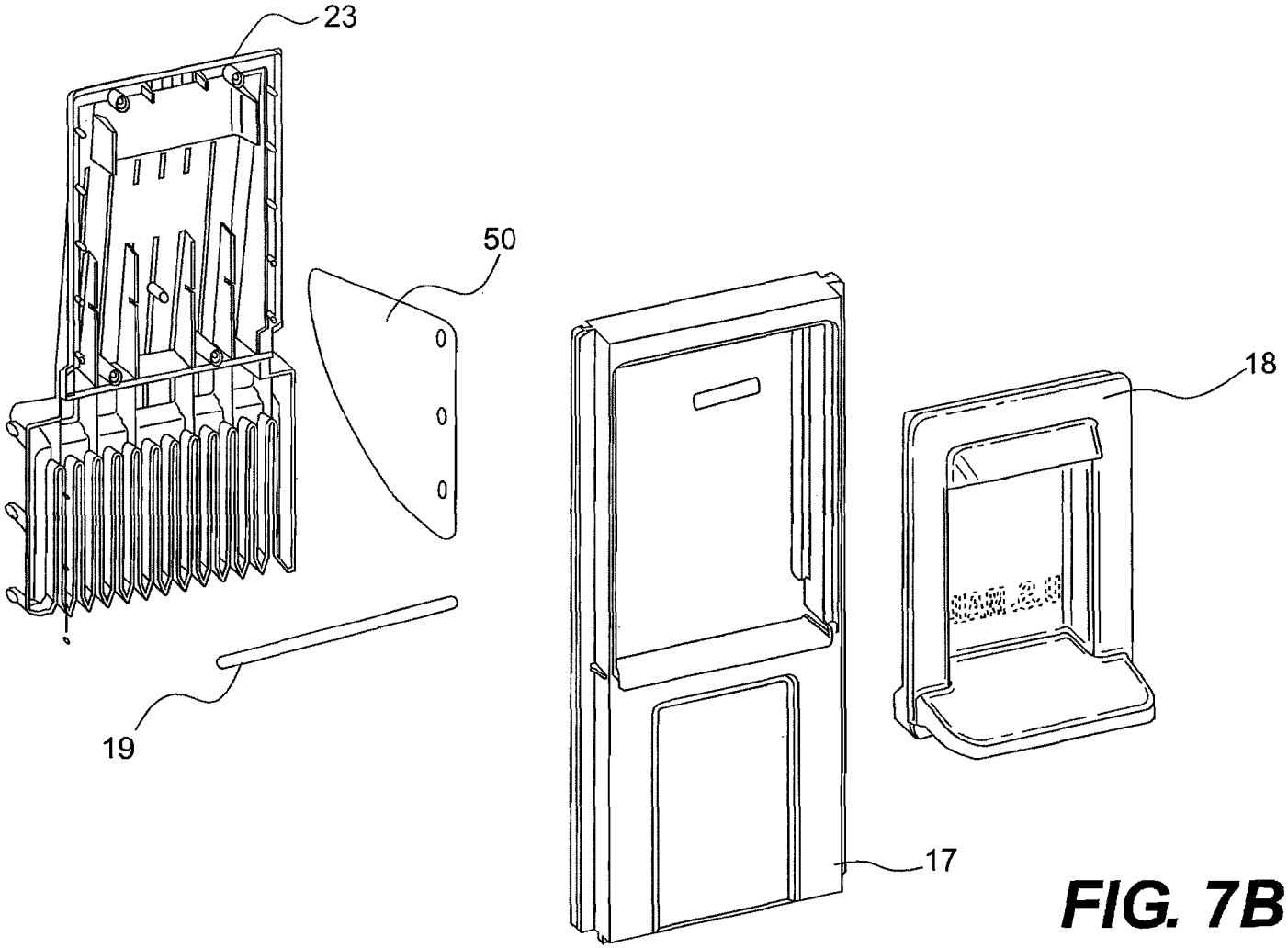
Figure 7C:
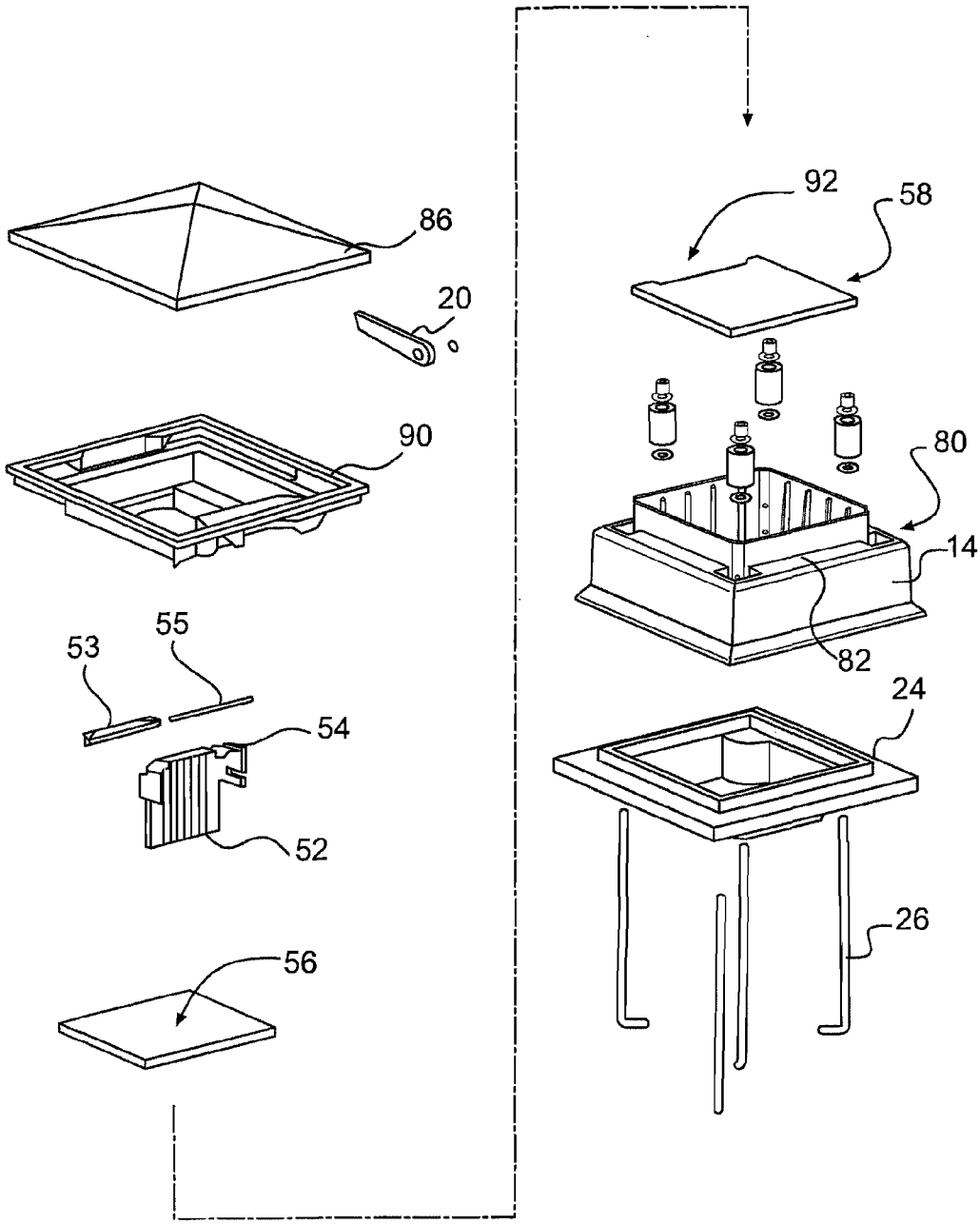

With reference to FIG. 7C, in the embodiment shown, top 12 includes flag 20, upper cap 88 and lower cap 90. As discussed herein, part of the modular design of receptacle 10 is that the top or roof 12 can be changed to match different architectural styles. Lower cap 90 is connected to upper cap 88 using known fasteners or bonding agents. Different roofs 12 of receptacle 10 may be provided by swapping upper cap 88 with different upper caps 88 or by removing entire top 12, i.e., upper cap 88 and lower cap 90, and replacing with new top 12. Lower cap 90 may also include upper shelf 56, not shown. Lower cap 90 also includes corner post holes and housing panel slots (not shown), similar to base 14.

In the embodiment shown, a space or cavity is created in top 12 between upper cap 88 and lower cap 90. The cavity is well illustrated in the cross-sectional views shown in FIGS. 2E-2G. In an embodiment, the cavity may be used to house devices that enhance receptacle 10. For example, cavity in top 12 may include a transmitter for transmitting a signal, e.g., when mail is deposited into receptacle 10. Transmitter could be battery-powered. Alternatively, top 12 could include a solar panel(s), with the solar receiver of the panel facing out through one of the sides of upper cap 88 and the body of the solar panel and any associated batteries for storing power in the cavity. Such a solar panel could power the transmitter or other devices such as lights or LEDs, e.g., that could be placed on the outside of receptacle 10, in upper compartment 42 and in lower compartment 44. The exterior lights would increase the security of receptacle 10 since lights tend to dissuade criminals. The interior lights would increase the usability of receptacle 10. Alternatively to solar panels, a simple battery pack placed in cavity could be used to power such devices. See FIGS. 15A-B below for an exemplary receptacle 10 with a solar panel.

With continuing reference to FIG. 7C, base 14 includes lower shelf/base cover 58. Also shown are plate 24, top portion 25, and J-bolts 26. Lower shelf/base cover 58 includes slot 92 for receiving bottom edge of access door 36. As discussed above, base 14 also includes corner post holes 80 and housing panel ledges 82. A variety of bases 14 may be used to change architectural appearance of receptacle 10. As part of modular design, a receptacle owner could be provided with different bases 14 and tops 12 to swap out to match different architectural styles as the owner saw fit.

With reference to FIG. 7A, among the various components of housing 16 shown are left and right side panels 94/95, corner posts or extrusions 96, corner pieces 98, front panel 100, upper rear panel 104, access door fillers 106, and access door strike 108. In an embodiment, left and right side panels 94/95 are one panel. Side panels 95, front panel 100 and access door fillers 106 are all set onto housing panel ledges 82 in base 14. These components are connected by inserting corner posts 96 into four corner post holes 80. Each corner post 96 includes channels or slots 97, facing perpendicularly to one another, into which facing edges of side panels 95, lower front panel 100 and access door fillers 106 are inserted. Alternatively, corner posts 96 are inserted into corner post holes 80 and then side panels 95, lower front panel 100 and access door fillers 106 are slid into corner post channels 97 from above.

Side panels 94, trap door 52 and front door assembly, and upper rear panel 104 may then be installed, with side panels 95, front door frame 17 (see below), and upper rear panel 104 being inserted into corner post 96 channels, e.g., by being slid into channels 97 from above until meeting top edges of side panels 94, front panel 100 and access door fillers 106, respectively, in channels 97.

Front door assembly includes front door frame 17. Front door frame 17 includes panel portion which may include decorative panel. Trap door 52 assembly preferably includes trap door hinge 55, which extends through trap door 52, and trap door bracket 53, which holds the hinge 55 ends and is fastened to the upper rear panel 104. Access door strike (not shown) is likewise preferably fastened to upper rear panel 104.

With reference to FIG. 7B, front door 18 assembly may include front door frame 17 that is likewise slid into corner post 96 channels above front panel 100. Front door 18 assembly also preferably includes front door hinge 19, that is inserted through front door 18 and has its ends inserted in front door frame 17, and front door back 23, which covers back of front door 18 and provides smooth surface for mail to be slid into upper compartment 42. Front door back 23 may also include front door extension 46, as shown.

With continuing reference to FIGS. 7A and 7C, after inserting the above components into corner posts 96, corner pieces 98 are inserted into corner posts 96. Top 12 may then be installed, with corner posts 96, side panels 95, upper rear panel 104 and front door frame being inserted into corner post holes and housing panel slots in lower cap 90. Upper shelf 56 and access door 36 may be installed into housing 16 at this time or prior to installation of top 12.

Figure 7D:
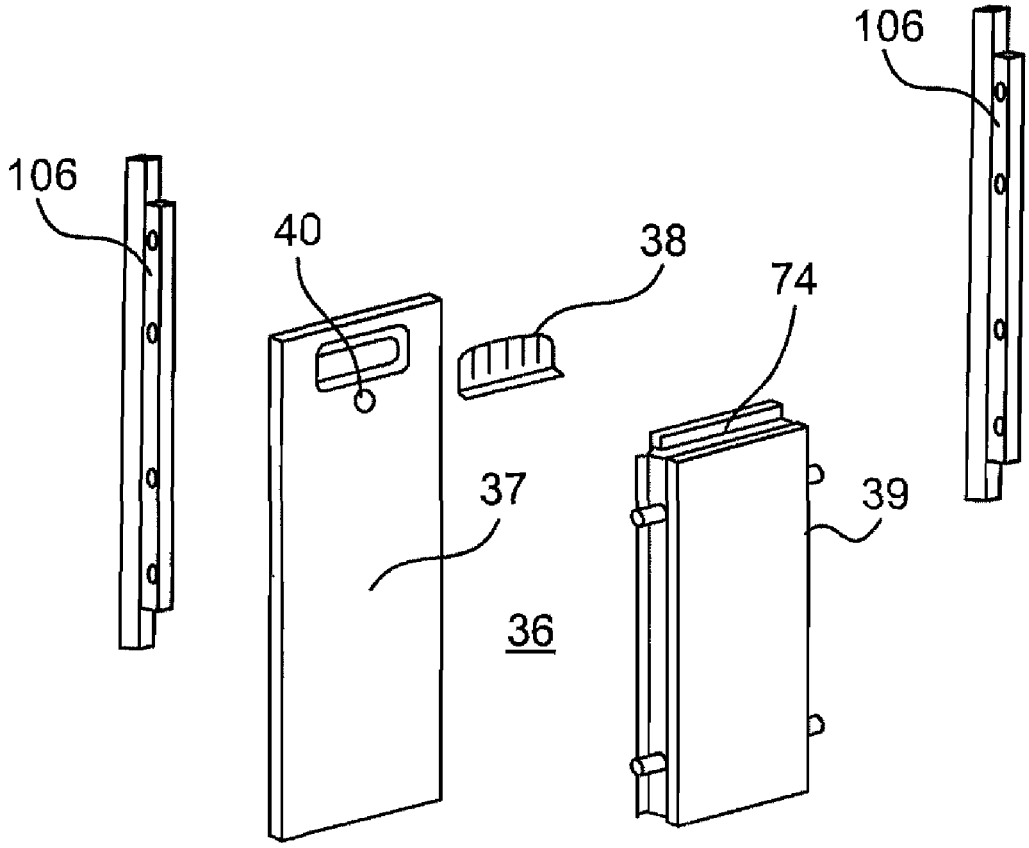

With reference to FIG. 7D, access door 36 is shown. Access door 36 includes handle 38, lock 40, access door cover 37 and access door body 39. Lock bolts 74 are seen extending out of access door body 39, which houses lock mechanism 62.

With reference again to FIG. 7A, corner posts 96 provide a dove-tail overlap of panels. Specifically, corner posts 96 include channels 97 that overlap panel edges when panels (e.g., side panels 94/95) are installed, so that panel edges cannot be easily accessed by a screwdriver or other similar prying device. This helps to prevent a would-be thief from prying lose one of the panels to access the vault portion 44. Accordingly, the overlap feature provides increases the security of receptacle 10. In an embodiment, the corner post may include multiple, parallel channels 97. The interior channels 97 may be used to hold structural panels, e.g., panels 95, 96, 100 and 104. The exterior channels 97 may be used to install decorative or function panels outside of structural panels. For example, see FIGS. 8A-B, 13B-G, 14A-C, and 15A-B.

With continuing reference to the embodiment shown in FIG. 7A, we see the exterior and interior channels 97. These additional channels are part of the modular design of receptacle 10, providing increased design flexibility. In the embodiment shown, interior or inner channels 97 are used for structural or base panels and exterior or outer channels are used for decorative or feature panels. Such decorative or feature panels may be thinner then structural panels. Consequently, outer channels 97 may be narrower then inner channels 97. See below for further discussion of these features.

Likewise, corner posts 96 attach to base 14 internally, fitting inside corner post holes 80 in base 14, without any external fasteners. Likewise, dove-tails overlap provided by channels 97 are internal and are not externally exposed, as discussed above. Together, these design feature eliminate the need for any external fasteners or other external access points that could be accessed by a would-be thief. The would-be thief cannot simply unscrew or otherwise unfasten a fastener to take apart or open receptacle 10. Therefore, these features provide increased security.

Furthermore, corner posts 96 may include two additional channels (not shown) facing opposite channels 97. The opposing channels enable two panels to be inserted into corner post 96 in same plane, side-by-side, rather than perpendicularly as shown, with corner post 96 in between the two panels. This feature enables construction of a plurality of side-by-side receptacles 10 or a single receptacle 10 with an enlarged lower compartment 44. Such an enlarged receptacle 10 might have a single front door 18 (e.g., on left or right) with, in affect, two lower housings 16 providing enlarged vault portion 44. In either side-by-side or enlarged receptacle 10 assemblies, base 14 would be enlarged to accommodate multiple panels (e.g., multiple front and rear panels) side-by-side.

Given ease of assembly, which is apparent from the above, receptacle 10 may be sold as a kit comprising the above-described components. Receptacle 10 owner could then purchase kit and assemble components as described above.

An additional feature provided by the modular design described herein is the ability to change the configuration of receptacle 10. In the embodiment shown with the square base 14, for example, the panels described herein may be swapped for one another. For example, rear panels and front panels may be swapped, placing access door 36 on front of receptacle 10, instead of rear. Likewise, rear panels and side panels may be swapped, placing access door 36 on one of the sides of receptacle 10. Such modularity allows for receptacle 10 to be installed in locations where a rear access is impractical or impossible (e.g., up against a building).

Likewise, such modularity allows for different applications of receptacle 10. For example, with access door 36 on front of receptacle 10, receptacle 10 may be used as an express mail/package drop box (e.g., a FedEx, UPS, DHL drop box). Express mail services driver would be given key to access door 36 lock. Users would deposit their express mail letters/packages through front door 18 and driver would retrieve from lower compartment 44. Such an embodiment may include a larger front door 18 and overall receptacle 10 to accommodate larger packages.

Embodiments of secure receptacle 10 described herein may be fabricated from a variety of materials. Among the requirements for the materials used for such embodiments are that the materials must be strong and durable. Consequently, various metals, such as steel or aluminum, plastics and composite materials may be used. Various fabrication methods, such as extrusion or injection molding may be used to fabricate components of receptacle 10 from such materials.

One of the many features of certain embodiments of secure receptacle 10 is that the embodiments are primarily fabricated from environmentally-friendly or renewable materials. In an embodiment, various recycled plastics and metals are used. For example, corner posts 96 are fabricated using extruded aluminum, which may be recycled aluminum. By using aluminum for corner posts 96, greater strength and resistance to entry or disassembly (e.g., through prying) is provided. Likewise, various access door components and related pieces, such as access door 36 and access door fillers 106, are preferably fabricated from steel, aluminum, titanium or other metals. Composite or other materials of similar strength and properties to metal may be used. Corner pieces 98 are formed from extruded recycled plastic; alternatively, different materials may be used, such as aluminum, cast pieces, etc. The various panels and shelves, including side panels 94/95, front panel 100, front door frame 17, upper rear panel 104, upper shelf 56 and lower shelf/base cover 58 are formed from extruded or injection-molded recycled plastic; alternatively, other materials may be used. Other components, such as top 12, base 14, front door 18 and front door extension 46, front door frame, trap door 52 and trap door extension 54 are formed from injection molded recycled plastic. Access door 36, including lock mechanism 62, and access door fillers 106 are formed from stainless steel, which may be recycled stainless steel.

Instead of using recycled plastics, as used in the embodiment described above, various components may be formed from a durable polymer compound known as thermoplastic elastomer (TPE). TPEs, sometimes referred to as thermoplastic rubbers, are a class of co-polymers which include materials with both thermoplastic and elastomeric properties. While most elastomers are thermosets, TPEs are in contrast relatively easy to use in manufacturing, for example, by injection molding and extrusion. TPEs show both advantages typical of rubbery materials and plastic materials.

The principal difference between thermoset elastomers and TPEs is the type of cross-linking bond in their structures. In fact, cross-linking is a critical structural factor which contributes to impart high elastic properties. The cross-link in thermoset polymers is a covalent bond created during the vulcanization process. On the other hand the cross-link in TPEs is a noncovalent bond, such as a weaker dipole or hydrogen bond. This cross-link is often referred to as a reversible cross-link.

TPE materials are recyclable since they can be molded, extruded and re-used like plastics, but they have typical elastic properties of rubbers which are not recyclable owing to their thermosetting characteristics. Specifically, normal cross-linked polymers cannot be recycled because they do not melt; these polymers do not melt because the cross-links tie all the polymer chains together, making it impossible for the material to flow.

A family of TPE materials are the thermoplastic vulcanizates or TPVs for short. TPVs are biphasic materials composed by a plastic phase and a rubbery phase which is cross-linked. The rubbery phase is cross-linked by chemical covalent bonds. The morphology of these materials can be described as a continuous phase of plastic, which contributes to mechanical properties and is responsible for the property of being recyclable, and a dispersed phase of covalently cross-linked rubber which is responsible for elastic properties. Generally TPVs show good mechanic-elastic properties at temperatures up to 110° C.

The TPEs used for components are preferably an ultraviolet (UV)-stabilized polyethylene. Such TPEs are inert to rain, water, snow, ice, sun, and acid-rain. Such inert features enable receptacle 10 last a long time in a variety of climates and environments, from the harshest sun to the coldest rain.

The TPEs used for components of secure receptacle 10 are preferably recycled TPEs. By using recycled TPEs, secure receptacle 10 is a recycled, recyclable product, minimizing the environmental impact of secure receptacle 10. Embodiments of secure receptacle 10 may be entirely fabricated from recycled materials, maximizing its environmental friendliness.

As mentioned above, one of the features provided by the modular design of receptacle 10 is the ability to change the appearance of receptacle 10. As described with reference to FIG. 8A below, for example, various panels such as intermediate front panel 102 may have a logo or other design placed thereupon. Other decorative features, such as different textures, faux-material, such as faux-stone, and others may be provided.

Figure 8A:
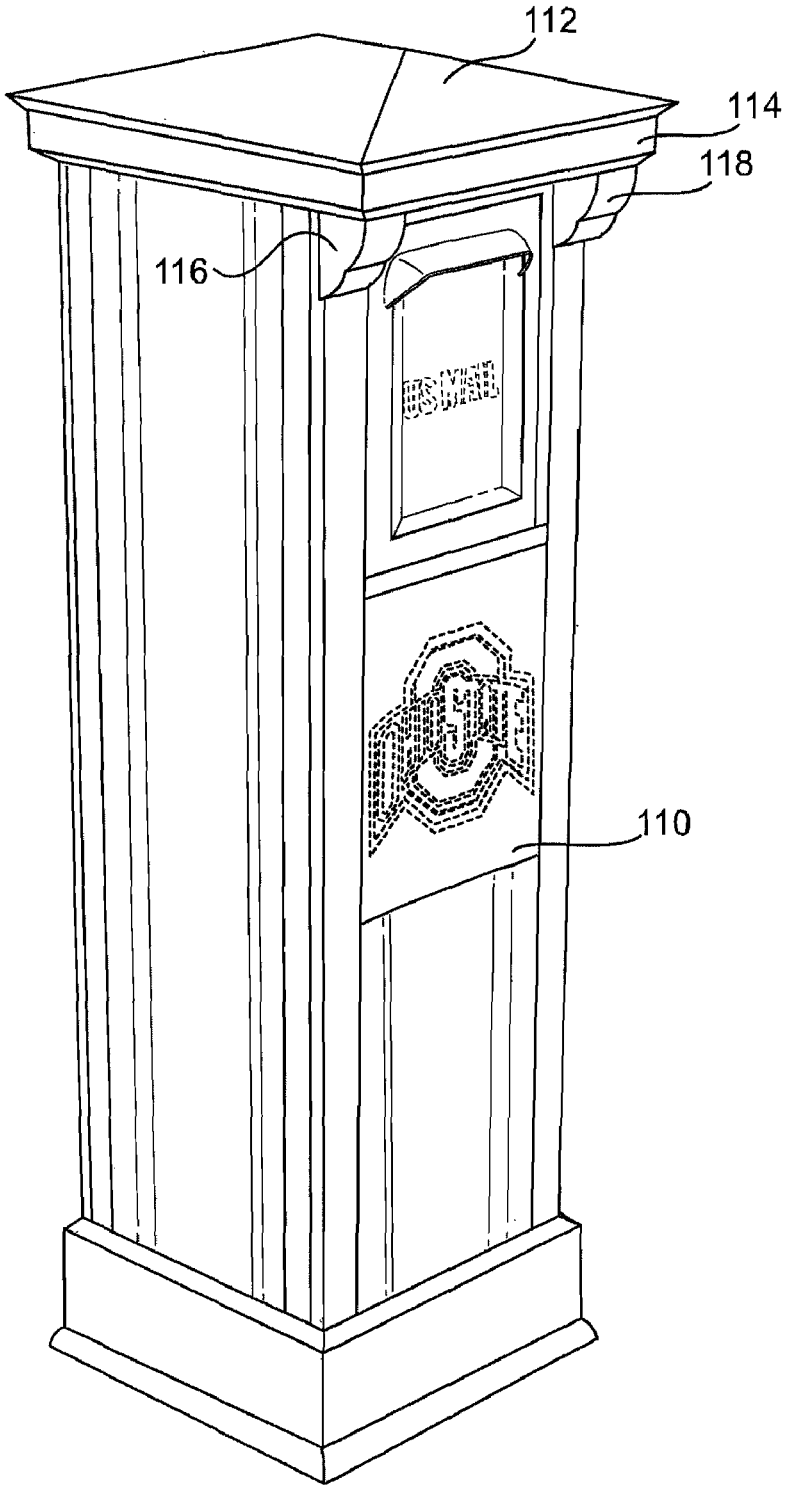
FIGS. 8A-8B are views of embodiments of an apparatus for secure postal and parcel receipt and storage with optional decorative and functional modular panels.
Figure 8B:
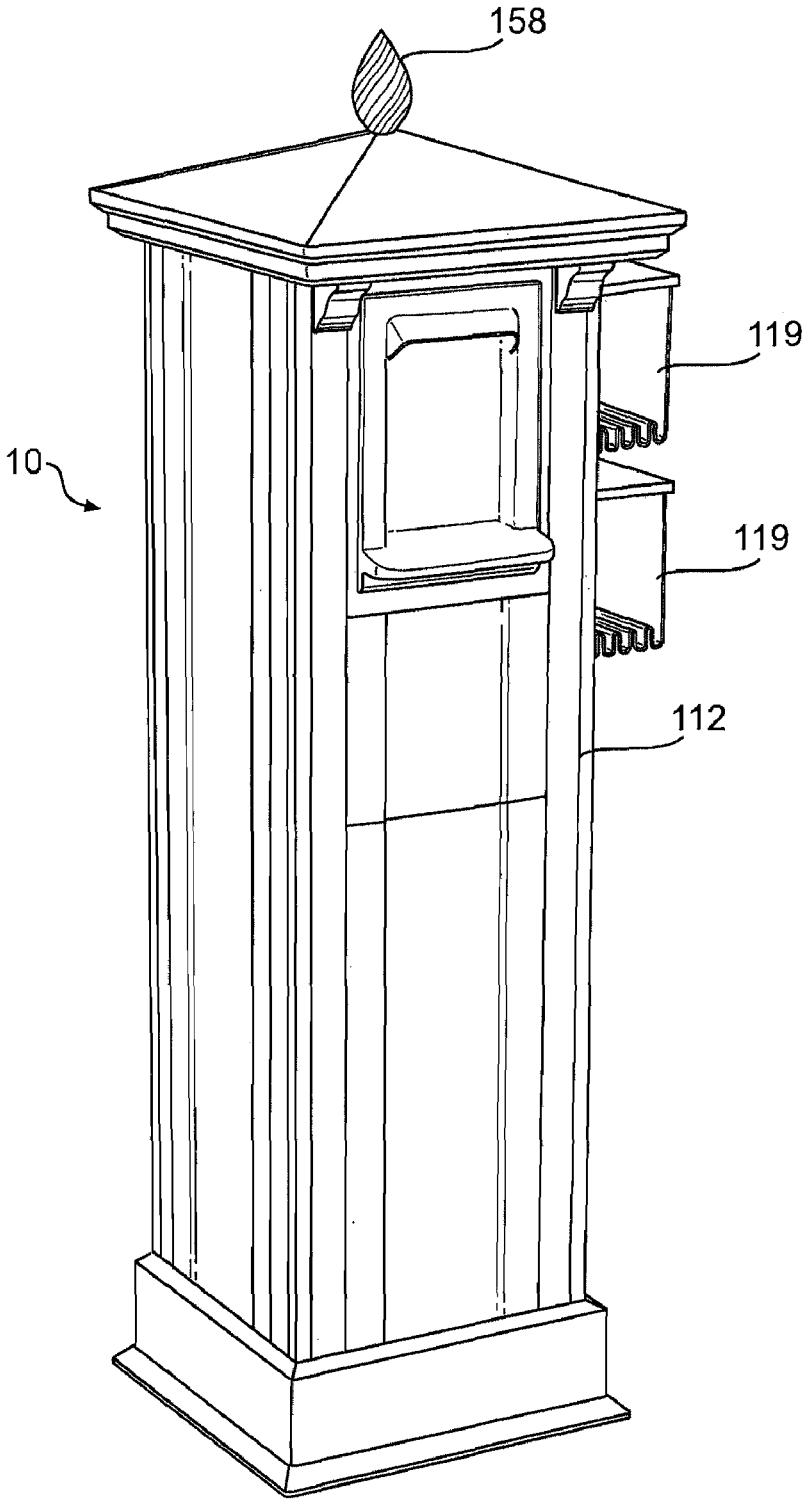

With reference now to FIG. 8A, shown is a perspective front view of another embodiment of secure receptacle 10 illustrating one of the many decorative features provided by receptacle 10. In the embodiment shown, front door frame 17 includes a logo panel 110. In other embodiments, other panels or components of receptacle 10, such as side panels 94/95, front panel 100 or upper rear panel 104, may also be logo panels 110. Logo panel 110 replaces a plain, standard panel with a panel with a logo on it. The logo may be virtually any logo desired by receptacle 10 owner, such as, e.g., a university or other school logo, sport team logo, business logo, company logo, organization logo, etc. Alternatively, logo panel 110 may have a name or other text on it, such as a person's name, company's name, school's name, an address, etc. Alternatively, logo panel 110 may have some other decorative feature or artistic design on it (e.g., paintings, photos, etc.). Logo panel 110 shown displays logo and name of The Ohio State University. Logo panel 110 enables receptacle 10 owner to personalize receptacle 10. Logo panel 110 may be formed by injection molding or extrusion. Logo may be formed in mold or printed or otherwise impressed upon logo panel 110.

A receptacle 10 owner may want multiple logo panels 110, e.g., in order to display logos corresponding to local sports teams by season (e.g., local MLB team during summer, NFL team during fall, NBA team during winter, etc.). Receptacle 10 owner could purchase logo panels 110 separately or as part of a receptacle 10 kit. Receptacle 10 owner could then assemble receptacle 10 from kit with chosen logo panel 110. When owner desired to change logo panel 110, owner would partially disassemble receptacle 10 and replace installed logo panel 110 with a new logo panel 110.

In an alternative embodiment, logo panel 110 does not replace a standard panel. Rather, logo panel 110 is a thinner decorative panel or sheet that can be installed in front of or over front door frame 17 or other panel. For example, such alternative logo panel 110 could adhere or otherwise be attached to front door frame 17 or other panel. Alternatively, with reference to corner posts 96 shown in FIG. 7A, logo panel 110 is a decorative panel that is installed into exterior or outer channels 97. In this manner, logo panels 110 can be easily swapped in and out of receptacle 10 without ever taking apart or otherwise structurally affecting receptacle 10.

Exterior or outer channels 97 enable a variety of optional panels, both decorative and functional, to be installed in receptacle 10. For example, with reference to FIG. 8B, a newspaper tube panel 112 may be installed on side, e.g., of receptacle 10. As shown, newspaper tube panel 112 may include a plurality of newspaper tubes 113. Newspaper tube panel 112 may be set into exterior or outer channels 97 of corner posts 96 along side of receptacle 10. This would enable newspaper company to provide newspaper tube panel 112 to new subscribers that have receptacle 10. Alternatively, newspaper tube panel 112 may be a panel with a universal adaptor (not shown) to which any of a variety of newspaper tubes supplied by newspaper companies could be connected. Receptacle 10 owner would connect newspaper tube into universal adapter and install newspaper tube panel 112 into receptacle 10. Other attachments that could connect to universal adapter may be provided as well. In another embodiment, newspaper tube panel 112 would not be installed in exterior or outer channels 97 but would be installed in interior or inner channels 97, replacing a base panel. Receptacle 10 also includes a decorative finial 158 on top 12.

With reference now to FIGS. 9-13G, shown are perspective front views of alternative embodiments of secure receptacle 10 with a variety of tops 12. As discussed above, top 12 may have a variety of shapes. The shape of top 12 may be chosen to match the roof of house in front of which receptacle 10 is installed. As discussed above, top 12 in FIGS. 1 and 8 has a four-sided pyramid shape roof 114 with a thick band 116 wrapping around beneath roof 114 overhang and two stylish brackets 118 extending down from bottom of roof 114.

Figure 9:
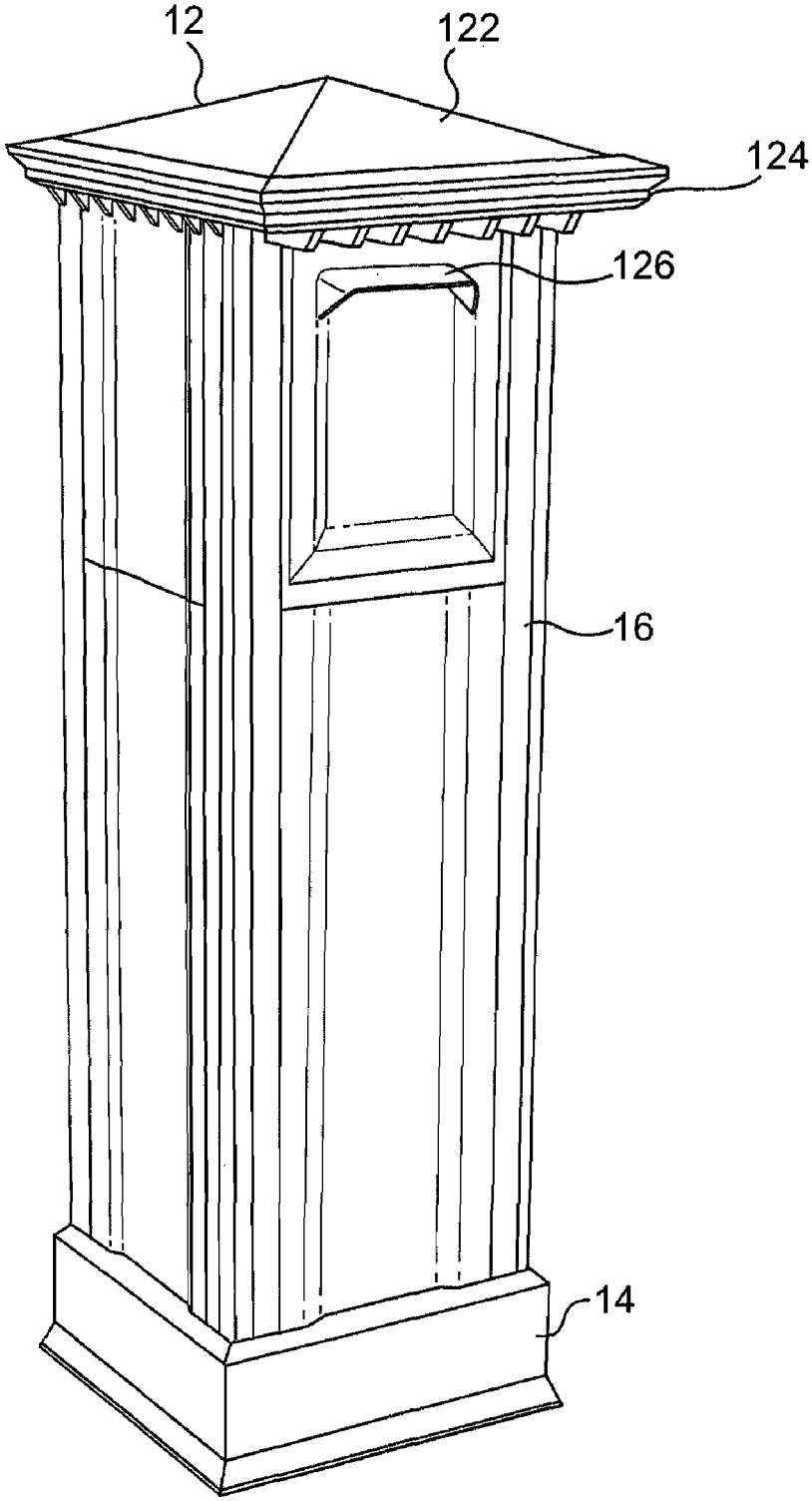
FIGS. 9-13G are views of various embodiments of an apparatus for secure postal and parcel receipt and storage.
Figure 10:
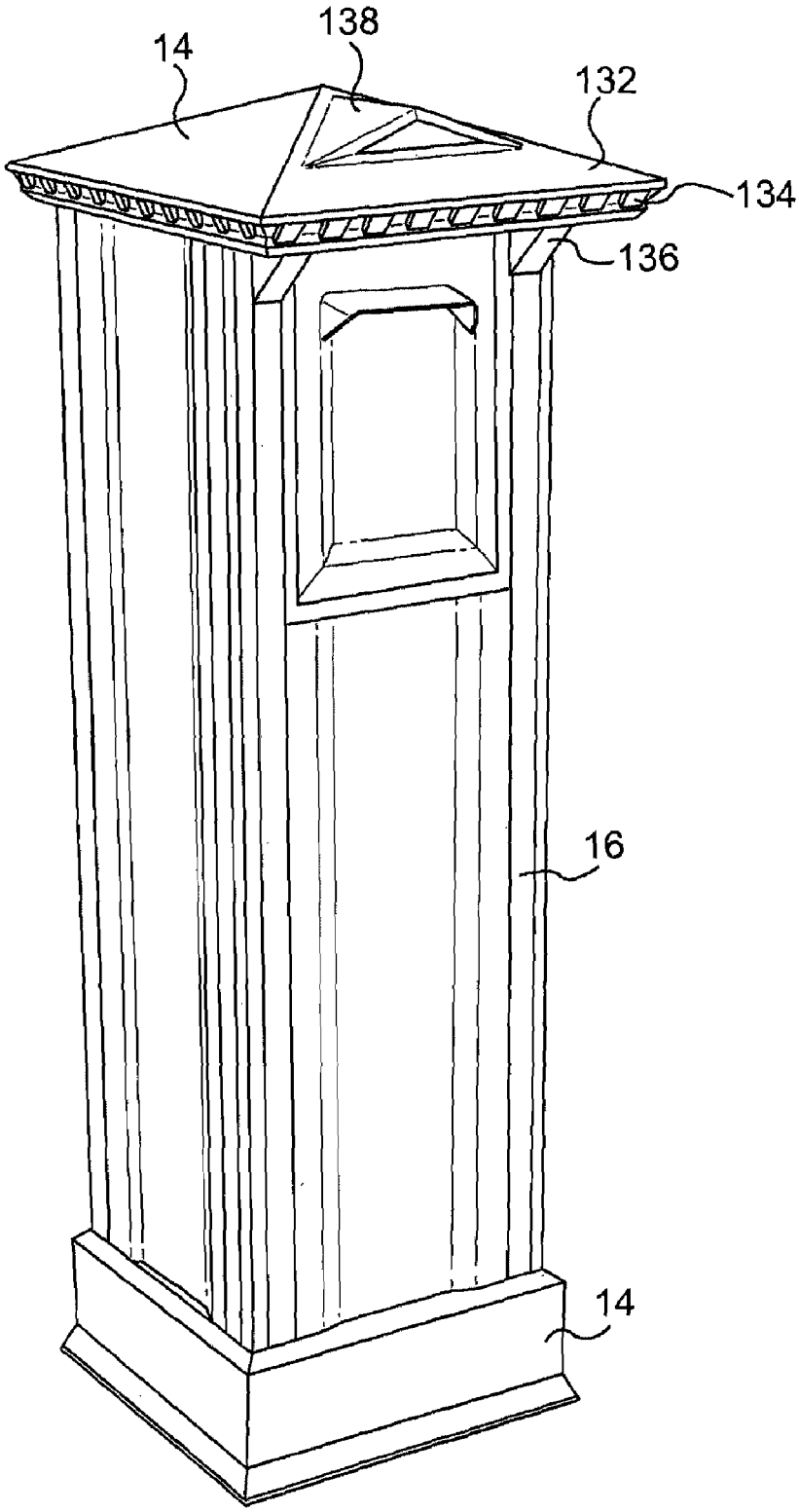
Figure 11:
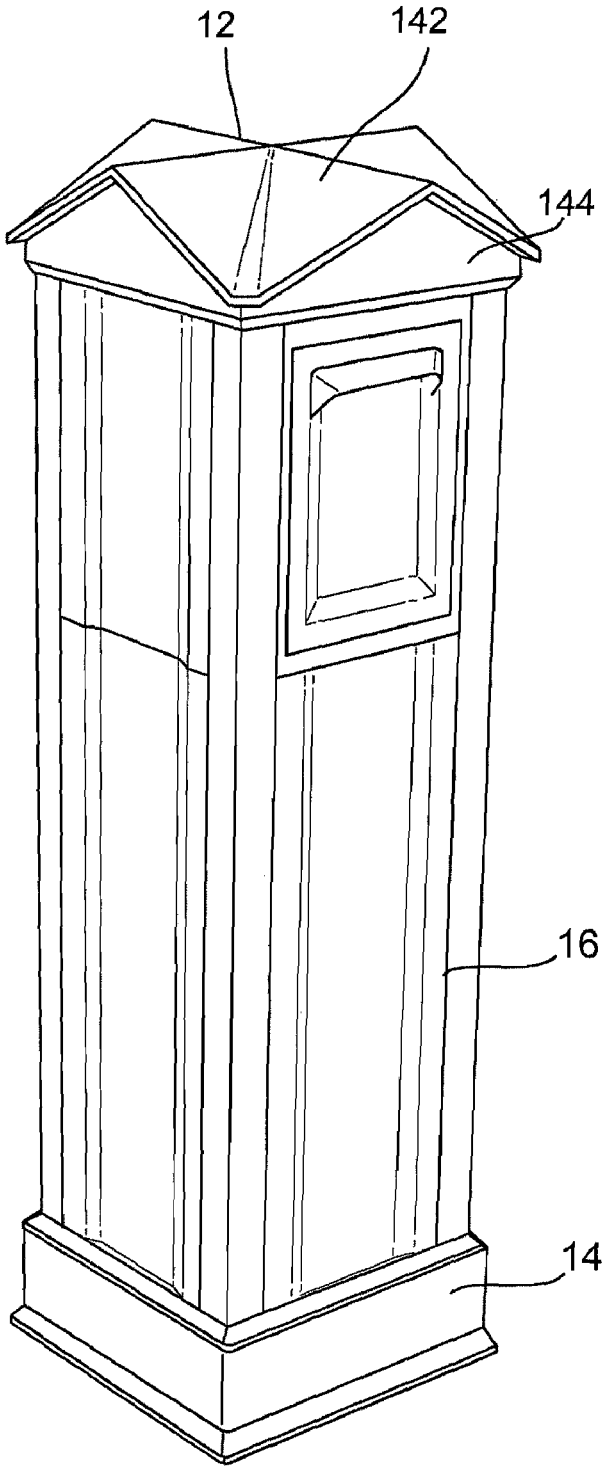
Figure 12:
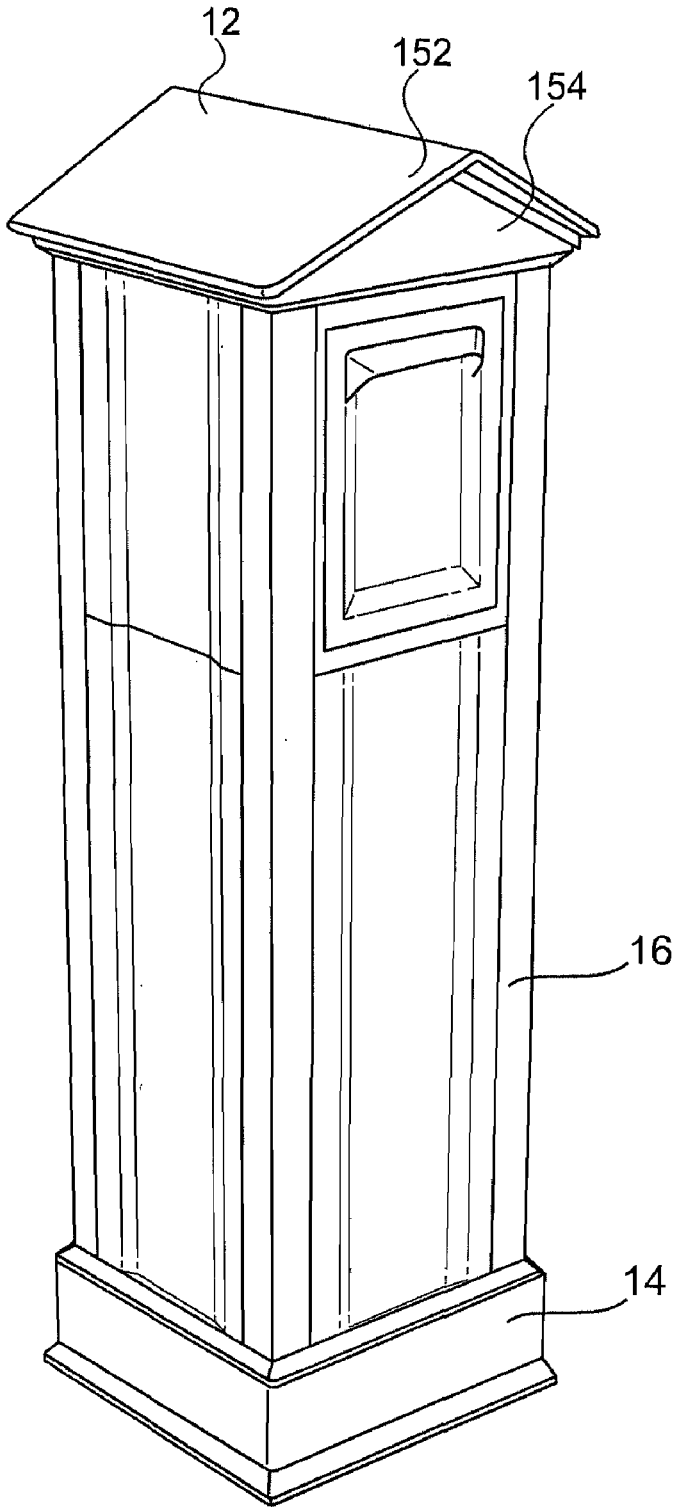
Figure 13A:
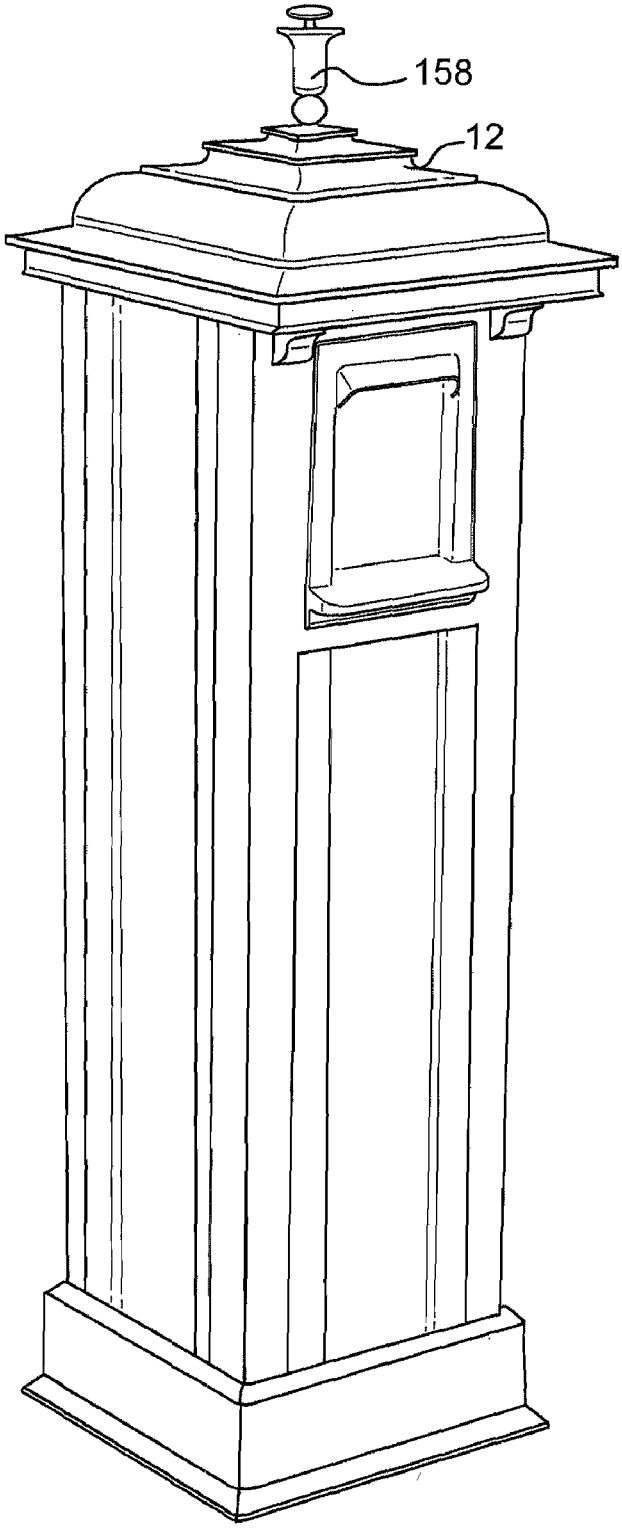
Figure 13B:
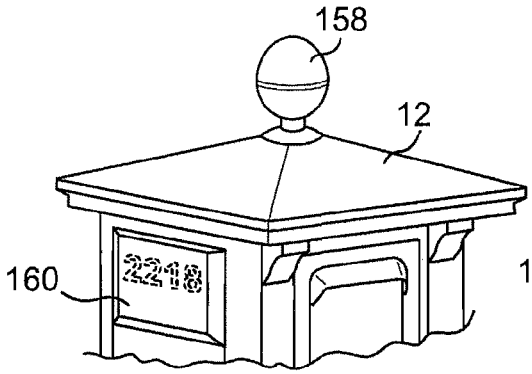
Figure 13C:
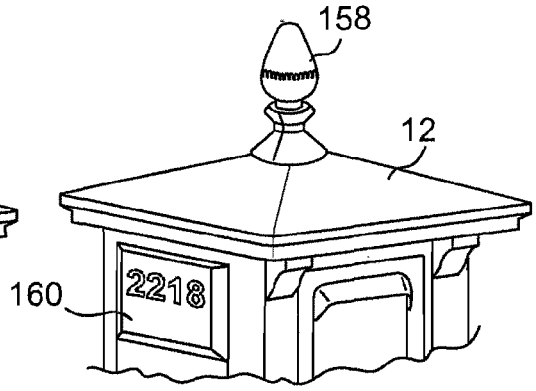
Figure 13D:
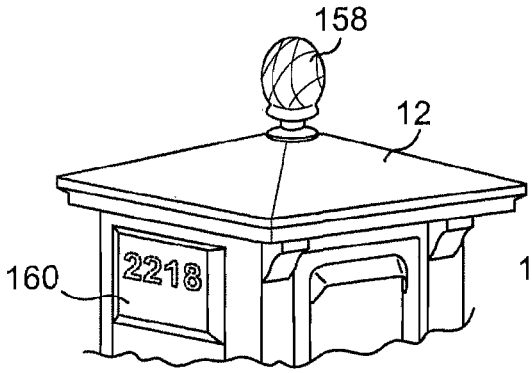
Figure 13E:
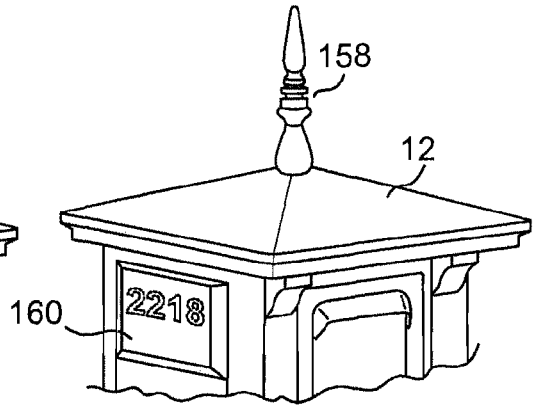
Figure 13F:
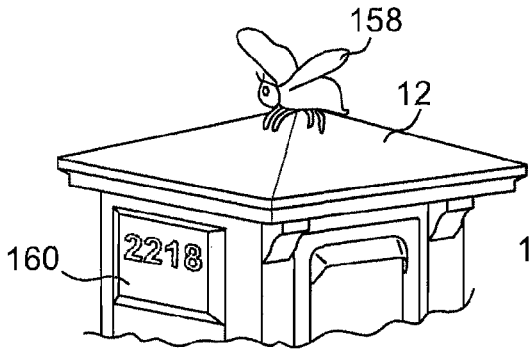
Figure 13G:
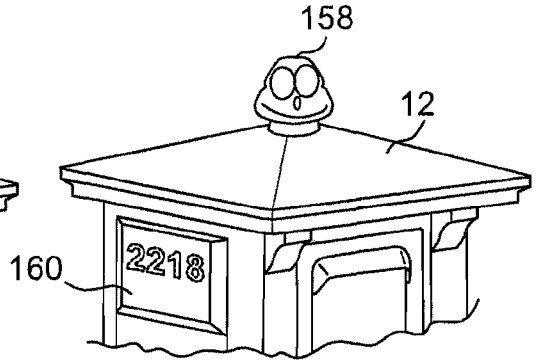

With reference to FIG. 9, shown is top 12 with a four-sided pyramid shape roof 122 with narrow band 124 wrapping around beneath roof 122 overhang and a series of joist-like trim pieces 126 extending from under-side of band 124 to top of housing 16. With reference to FIG. 10, shown is top 12 with a four-sided pyramid roof 132 with a stylish band 134 wrapping around beneath roof 132 overhang and two stylish brackets 136 extending down from bottom of roof 132. Roof 132 also has a gable-like feature 138 that extends out from top of roof 132. With reference to FIG. 11, shown is top 12 with a four-peak roof 142. Four-peak roof 142 actually has eight sides, one on each side of each peak, and vertical surface 144 under each peak. With reference to FIG. 12, shown is top 12 with a two-side, single peak roof 152. Single-peak roof 152 has vertical surface 154 under each side of the peak. In an alternative, single-peak of roof 152 extends from side to side of receptacle 10 instead of front to back as shown. With reference to FIGS. 13A-G, shown is top 12 with a plurality of fanciful finials 158. FIGS. 13B-13G also include a decorative address label 160. Decorative address label 160 may be part of a decorative panel that fits in exterior or outer channels 97 of corner posts 96 over side panel 94. Alternatively, decorative address label 160 may be a separate piece that affixes to side panel 94/95.

With continued reference to FIGS. 9-13G, housing 16 panels, front door 18 and access door 36 may be fabricated to have an appearance matching the material of the house siding, nearby fence or other structural feature on property. TPEs, which may be used for panels as described above, may be fabricated to have appearances similar to a variety of materials, such as marble, concrete, vinyl siding, brick and wood. For example, receptacles 10 shown in FIGS. 1 and 8 have a marble-like appearance. Receptacles 10 in FIGS. 9, 10 and 12 have a wood-like appearance while receptacle 10 in FIG. 11 has a vinyl siding-like appearance. It is also noted that receptacles 10 in FIGS. 9-13G do not appear to have a front panel 100 and a front door frame 17 but appear to have a single front panel. What is clear from the above is that receptacle 10 may have a variety of top shapes and faux-material appearances.

Figure 14A:
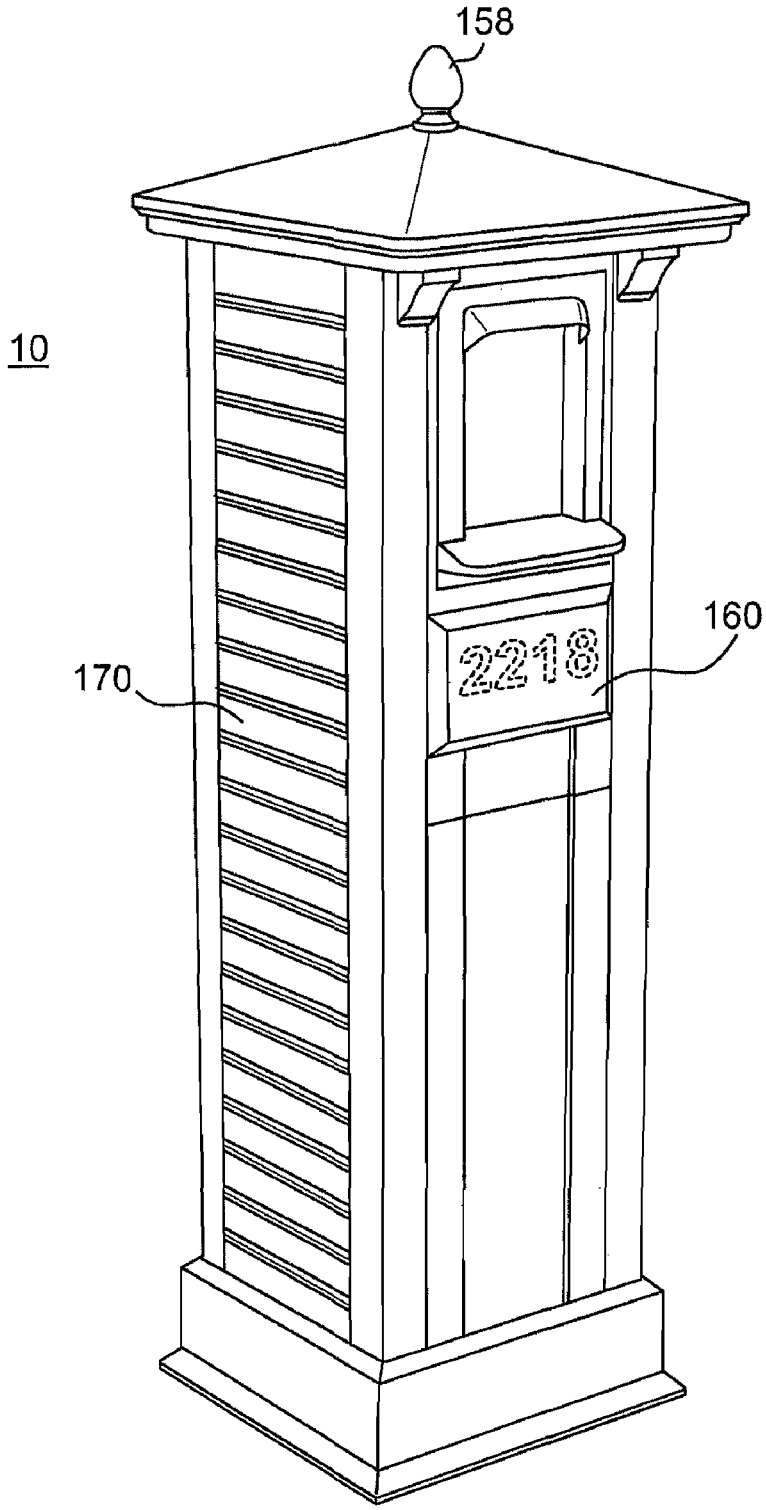
FIGS. 14A-14C are perspective front views of various embodiments of an apparatus for secure postal and parcel receipt and storage.
Figure 14B:
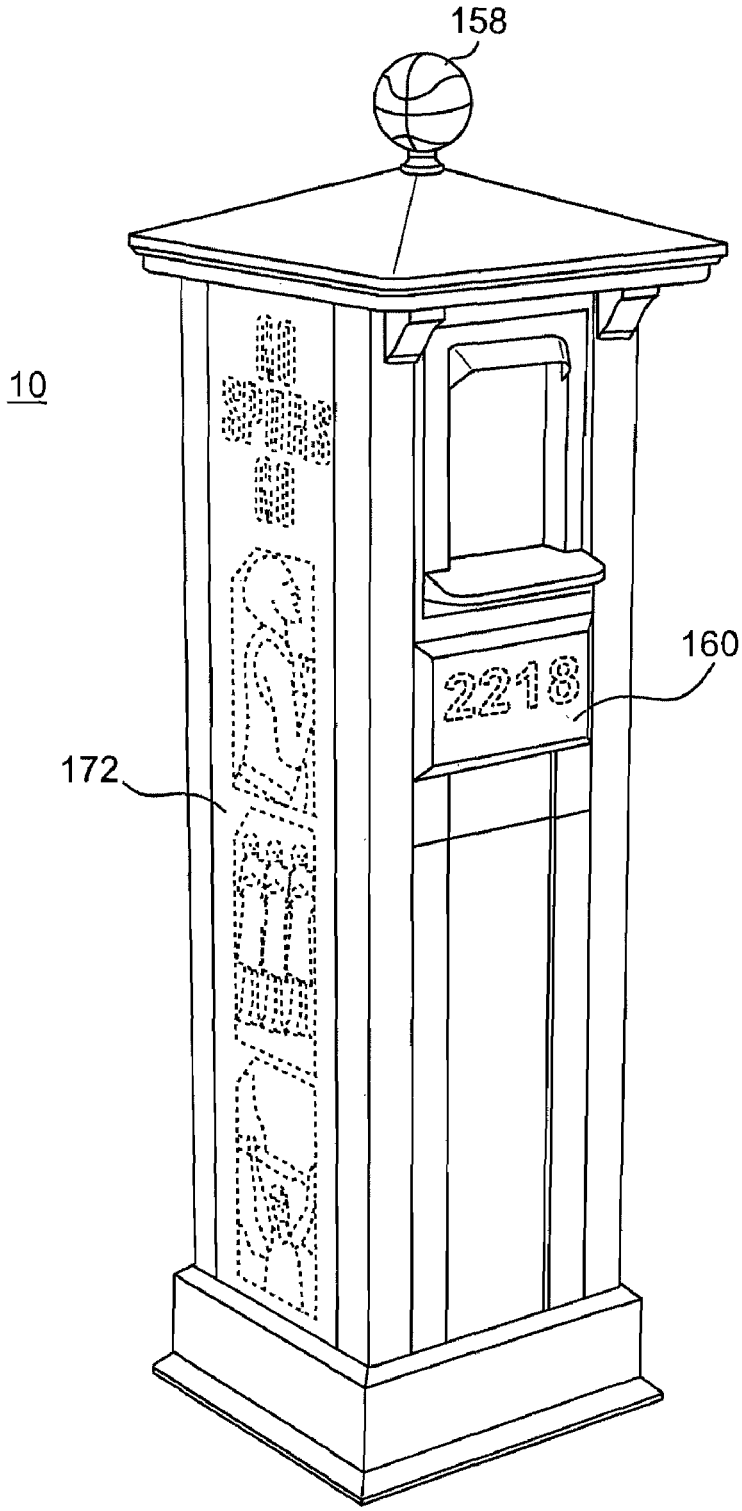
Figure 14C:
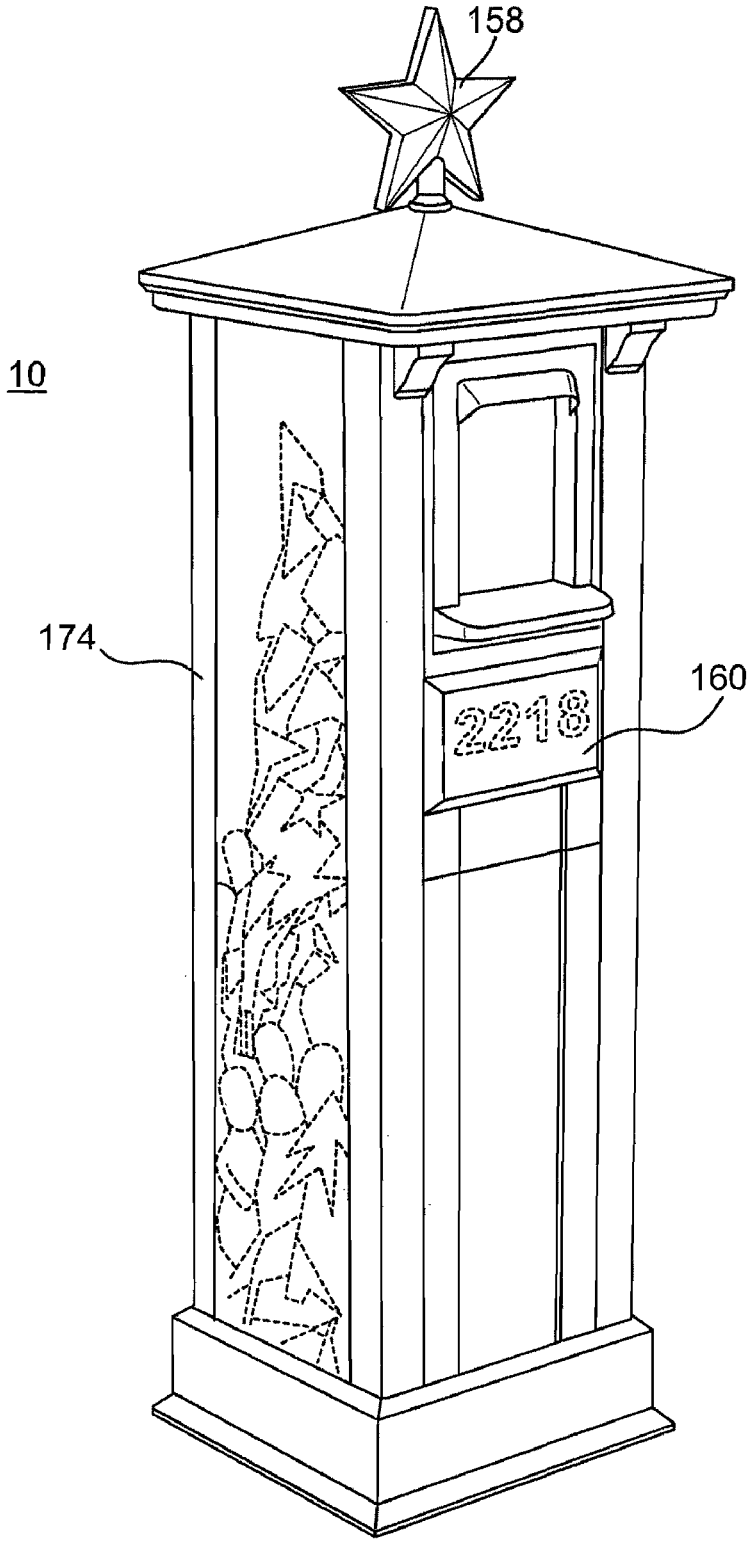

With reference to FIGS. 14A-C, shown are further embodiments of receptacle 10. These embodiments and the others discussed herein, illustrate the variety and flexible design possibilities provided by the modular design of receptacle 10. With reference to FIG. 14A, shown is receptacle 10 that has installed optional colonial style decorative side panels 170. In the embodiment shown, colonial style decorative side panels 170 are installed over side panels 94 in exterior or outer channels 97 of corner posts 96. Colonial style decorative side panels 170 provide a wood-slat appearance. Virtually any styles, such as stucco and exposed beam Tudor style, stone English country-side style, etc., may be provided by optional decorative panels. Such optional decorative panels may be installed by the home-owner. Receptacle 10 also includes a decorative finial 158 and decorative address label 160. Decorative address label 160 may be an optional decorative panel installed over front door frame 17.

With reference now to FIG. 14B, shown is receptacle 10 with optional team spirit decorative side panels 172. In the embodiment shown, optional team spirit decorative side panels 172 are installed over side panels 94 in exterior or outer channels 97 of corner posts 96. Optional team spirit decorative side panels 172 include photos, slogans, logos, branding, etc. representative of a team. Any type of branding, whether representative of a team, product, movie, book, etc. may be displayed on an optional decorative side panel. Such optional decorative panels may be installed by the home-owner. Receptacle 10 also includes a decorative finial 158 and decorative address label 160. Decorative finial 158 shown here is a team spirit finial 158 that corresponds to team spirit decorative side panels 172. In this case finial 158 is a basketball. Such finials 158 may be installed by owner (e.g., by screwing on).

With reference now to FIG. 14C, shown is receptacle 10 with optional seasonal decorative side panels 174. In the embodiment shown, optional seasonal decorative side panels 174 are installed over side panels 94 in exterior or outer channels 97 of corner posts 96. Optional seasonal decorative side panels 174 include a painting, photos, drawings, or other decor representative of a season or holiday, in this case Christmas season. Any type of seasonal or holiday decor may be displayed on an optional decorative side panel. Such optional decorative panels may be installed by the home-owner. Receptacle 10 also includes a decorative finial 158 and decorative address label 160. Decorative finial 158 shown here is a seasonal finial 158 that corresponds to seasonal decorative side panels 172. In this case finial 158 is a star. Such finials 158 may be installed by owner (e.g., by screwing on).

Figure 15A:
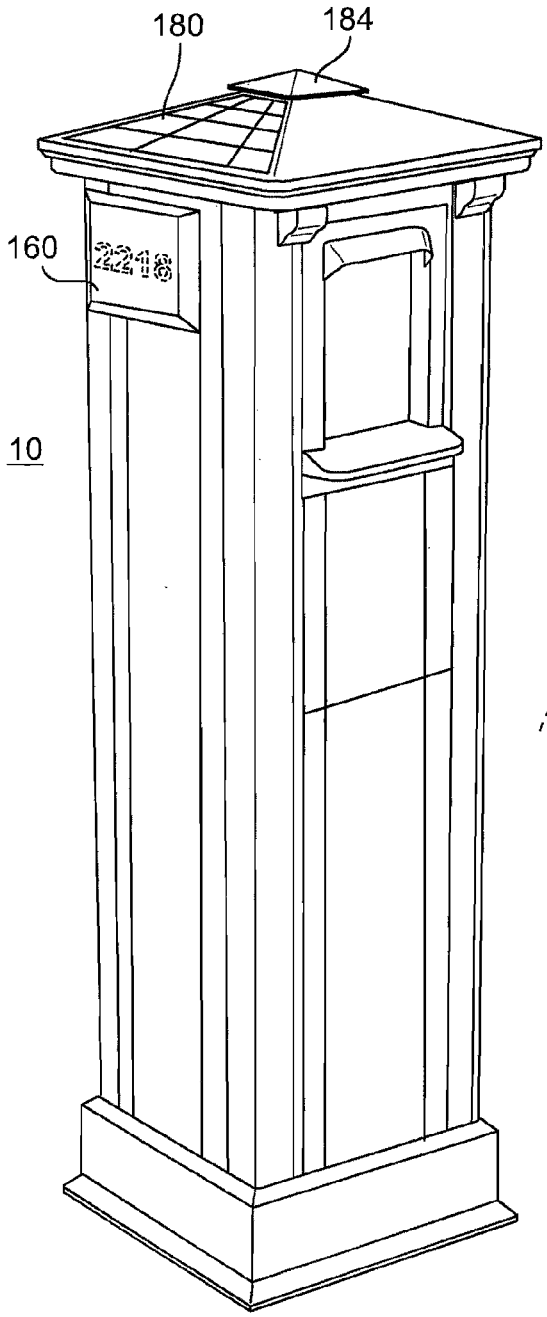
FIGS. 15A-15B are front perspective views of an embodiment of an apparatus for secure postal and parcel receipt and storage.
Figure 15B:
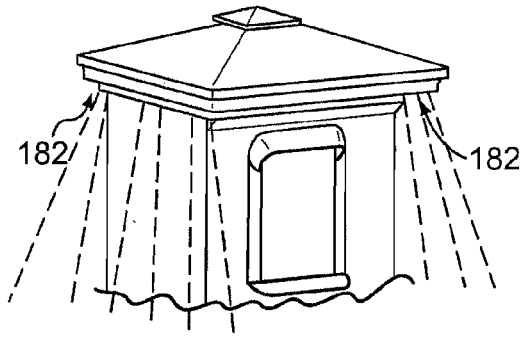

With reference now to FIG. 15A-15B, shown is another embodiment of secure receptacle 10 with solar panel 180 and lights 182. As discussed above with reference to FIG. 7A, solar panel 180 may be installed in top 12. Solar panel 180 collects solar energy and may store it in batteries (now shown) that are in cavity between upper cap 88 and lower cap 90 or elsewhere in receptacle 10. Lights 182 may be included, e.g., on sides of top 12 and may be powered by batteries to light sides of receptacle 10 (as shown in FIG. 15B). Additional lights (not shown) may be included in upper compartment 42 so as to light interior of receptacle 10. Solar panel 180, batteries and lights 182 may configured so that solar panel 180 fully charges batteries during day and lights 182 come on at dusk and discharge batteries during night. Receptacle 10 shown also includes decorate address panel 160, which is illuminated by lights 182. Top 10 also includes mini-roof finial 184 which may be removable to provide maintenance access to batteries and cavity.

With reference now to FIGS. 16A-16E, shown is another alternative embodiment of secure receptacle 280. Secure receptacle 280 shown is intended to be a wall-mounted or post-mounted version. Secure receptacle 280 includes a top 282, housing 284, front door 286, and access door 288. Receptacle 280 here is post-mounted so it includes post 290. Front door 286 operates in a manner similar to the front doors described above. When front door 286 is opened, trap door 294 is raised up. Mail or parcels are placed on trap door 294, front door 286 is closed and mail and/or parcels drop into housing 284. Access door 288 is locked with lock mechanism controlled by key hole 289.

Figure 16A:
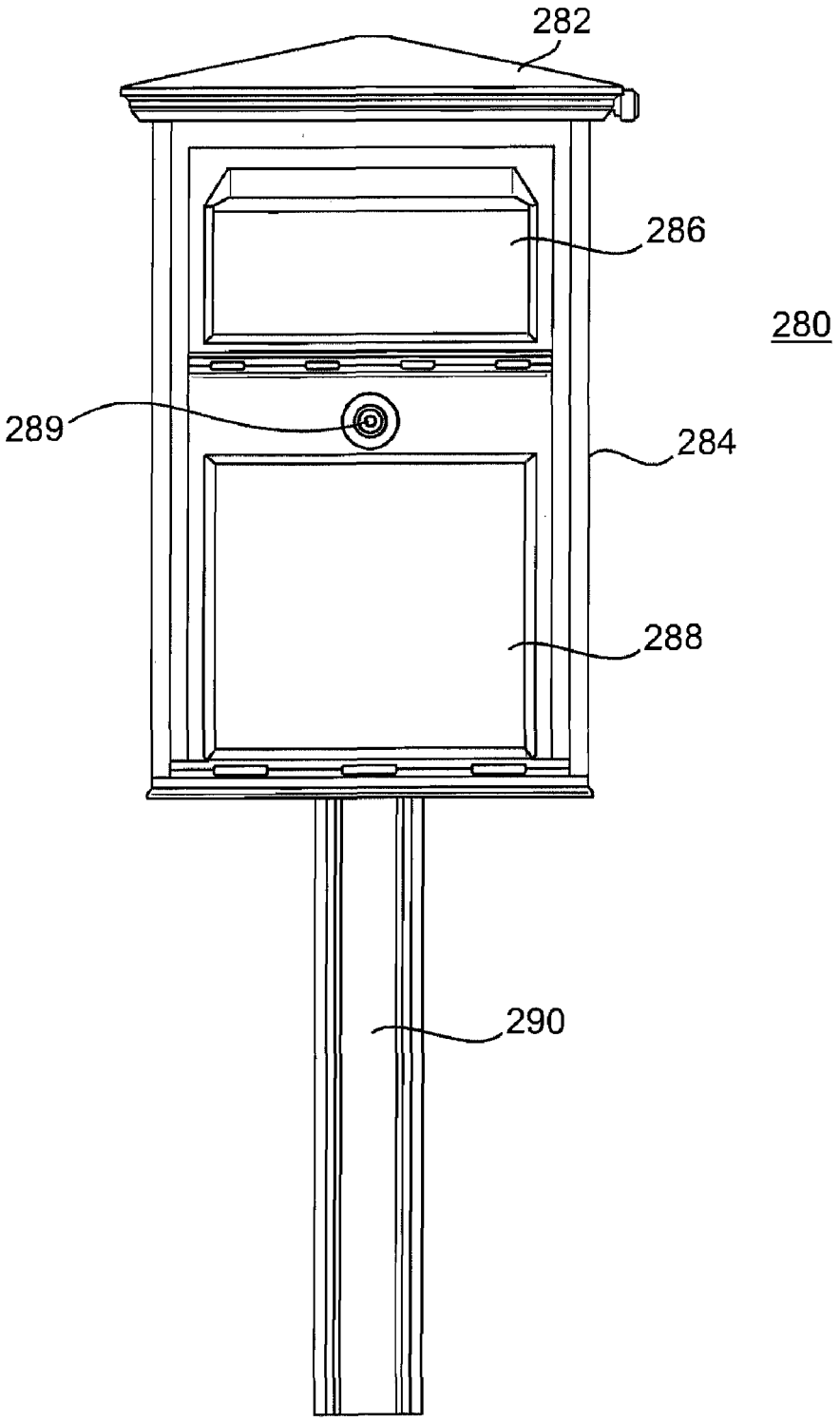
FIGS. 16A-16E are front, exploded and perspective front views of wall-mounted embodiments of an apparatus for secure postal and parcel receipt and storage and components thereof.
Figure 16B:
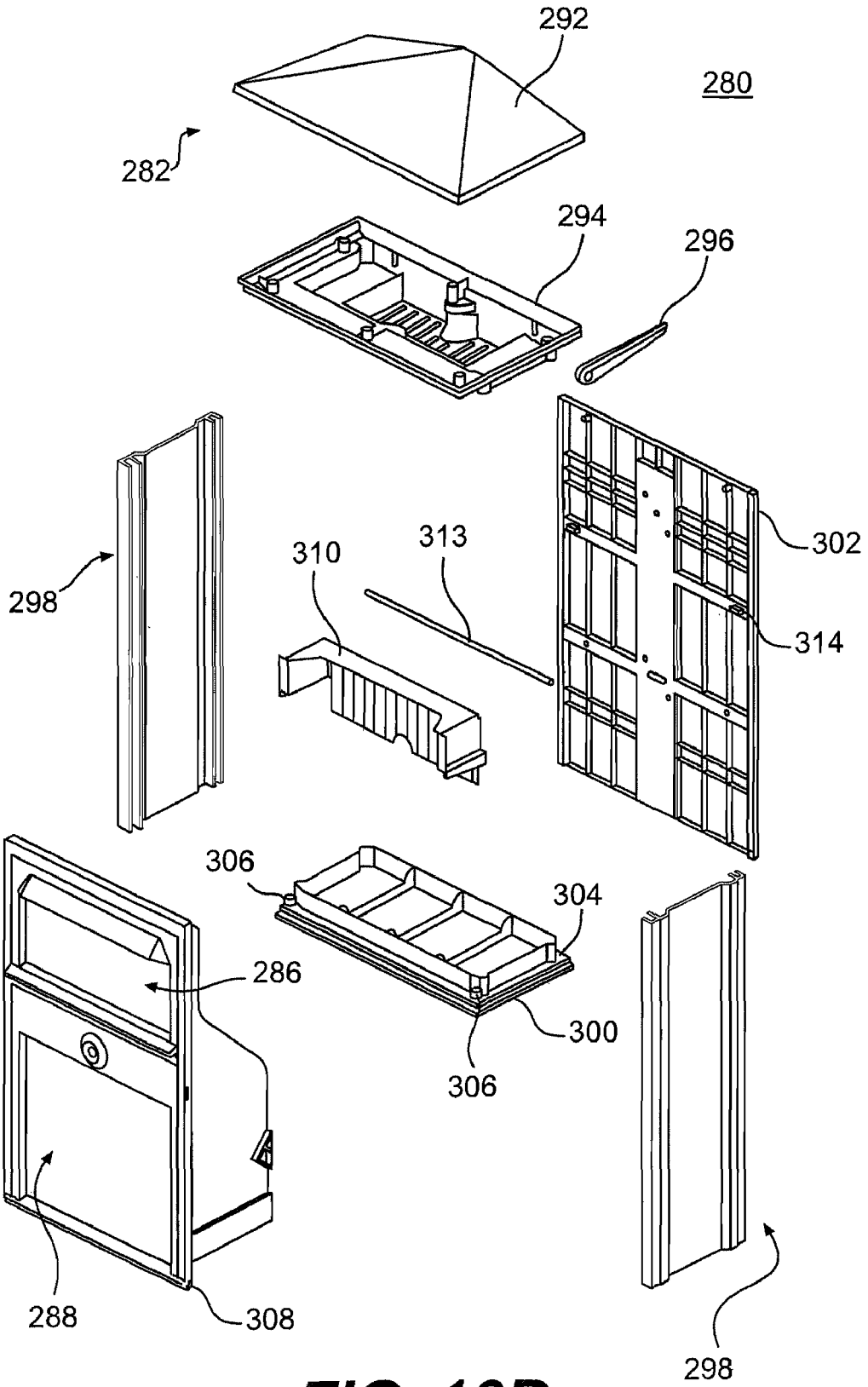

With reference now to FIG. 16B, shown are further details of secure receptacle 280. Top 282 is shown including two pieces, top cap 292 and top base 294, and flag 296. Housing 284 includes side panels 298, base 300 and rear panel 302. Side panels 298 and rear panel 302 are assembled into base 300 in a manner similar to receptacle 10 described above, sitting on panel ledges or slots 304 in base 300. Base 300 also includes hinge slots 306 for receiving hinge rod 308 of access door 288 in order to pivotably assemble access door 288 into housing 284. Trap door 310 is pivotably assembled into housing 284 with trap door rod 312 and rod holes 314 in rear panel 302.

Figure 16C:
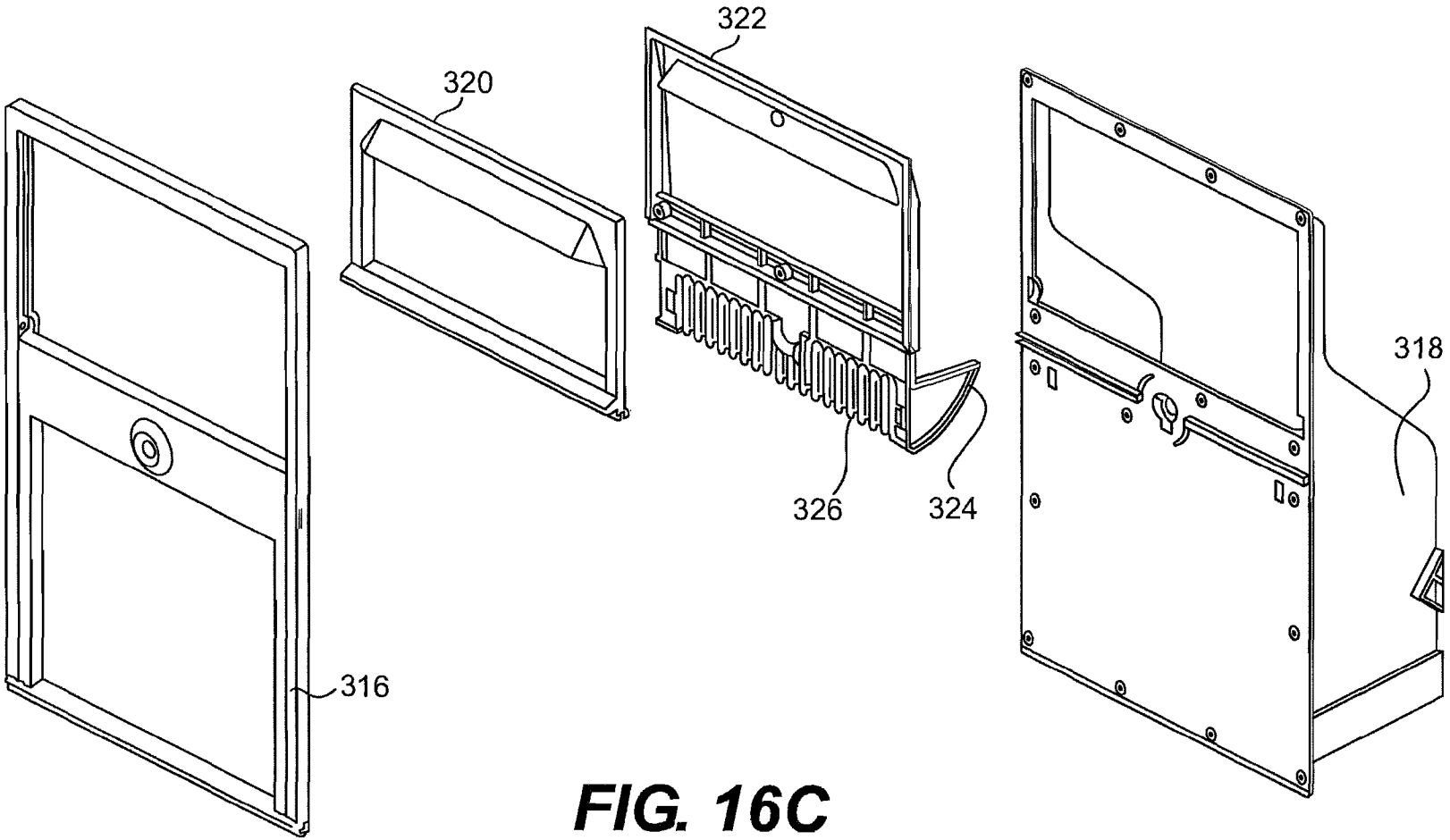

With reference to FIG. 16C, access door 288 and front door 286 are shown in greater detail. Access door 288 operates differently then embodiments shown above. Access door 288 includes lock mechanism operated by inserting key into key hole 289. Lock mechanism may be fabricated similar to lock mechanisms described above (with toggle arms and lock bolts). When key is inserted into key hole 289 and turned, access door 288 pivots open as shown. Access door 288 actually forms front of housing 284, rather than a separate door. By opening up entire housing 284, access door 288 provides easier access to deposited mail or parcels. As shown here, access door 288 includes access door front 316 and access door rear 318. Access door rear 318 may include bottom shelf (not shown) and generally contains mail deposited into receptacle 280. Also shown here, front door 286 includes front door facing 320 and front door backing 322. Front door backing 322 includes cam 324 and fingers 326. Cam 324 acts to cause trap door 310 to pivot closed when front door 286 is opened, in manner similar to receptacle 10 above. Fingers 326 serve similar purpose to fingers of front door extension 46 described above.

Figure 16D:
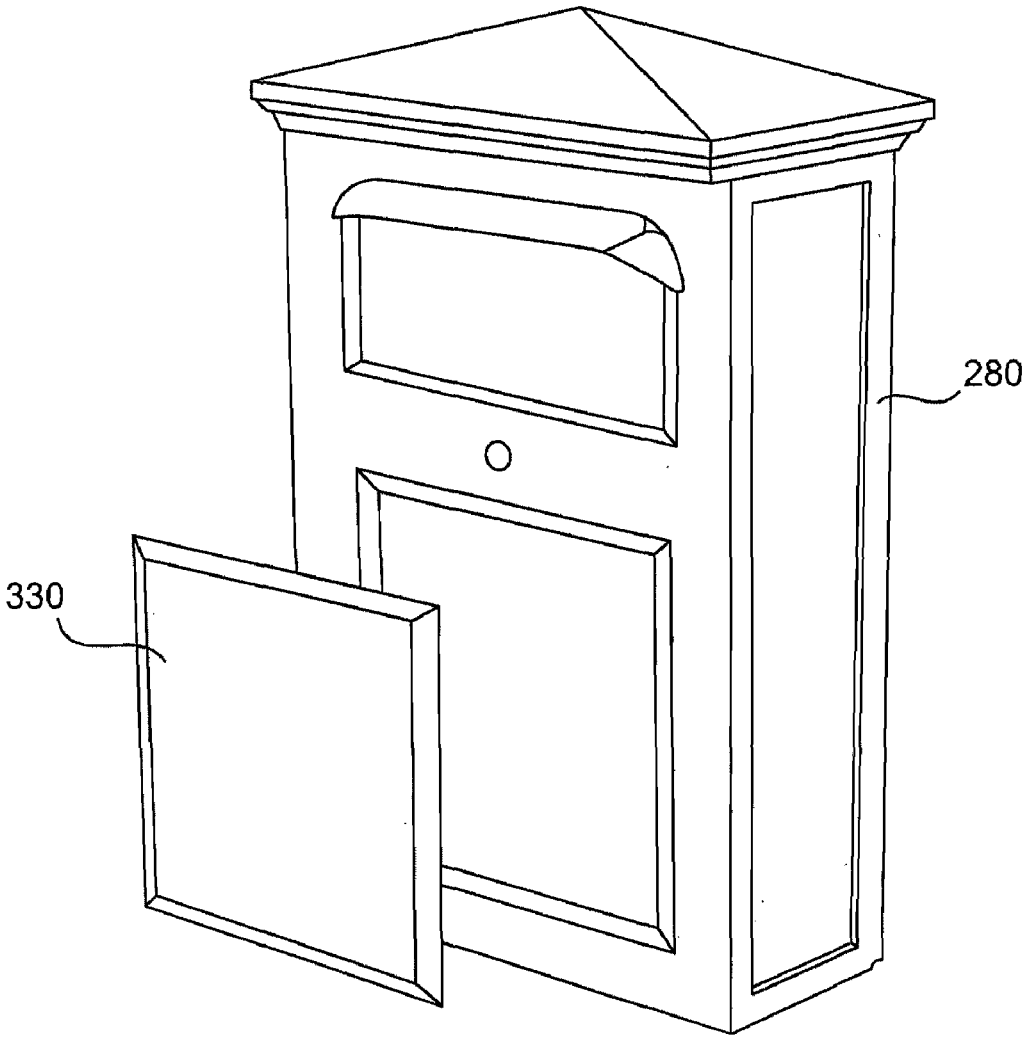

With reference to FIG. 16D, receptacle 280 is shown to include optional, removable front panel 330. Front panel 330 may be decorative or functional. Here, front panel 330 includes address number. Other images or designs may be included on front panel 330. Front panel 330 may be affixed to receptacle 280, e.g., with an adhesive or magnets. Receptacle 330 may be constructed similarly to receptacle 10, both in materials and components. For example, receptacle 330 may include corner posts with a plurality of slots for holding structural and decorative panels.

Figure 16E:
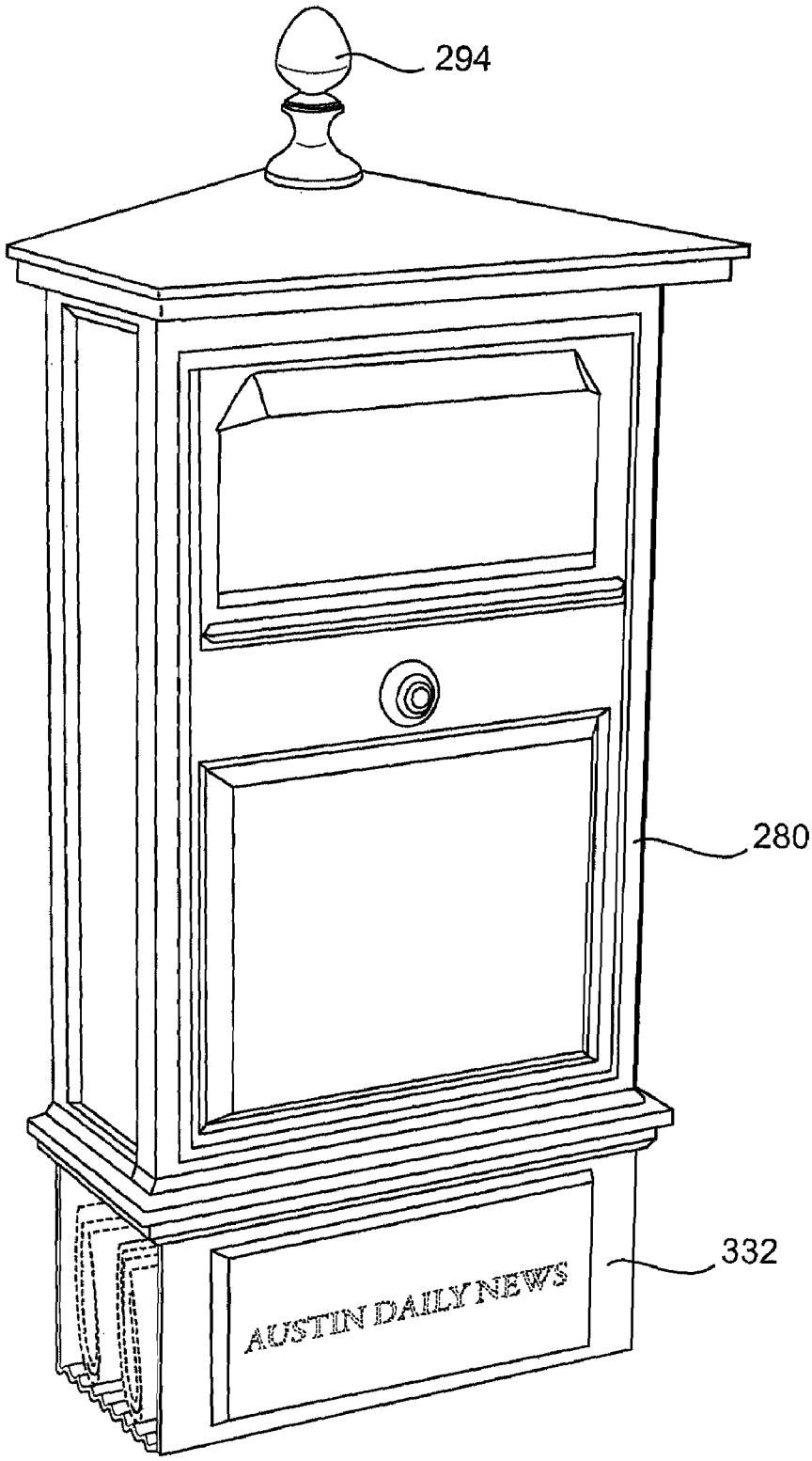

With reference to FIG. 16E, receptacle 280 is shown to include optional newspaper tube/holder insert 332. This figure illustrates that the wall-mounted embodiments of the secure receptacle may include many of the features of secure receptacle 10. Newspaper tube insert 332 may be affixed to receptacle 280 in a variety of manners, including by sliding newspaper tube insert 332 into channels in bottom of housing 284.

There are numerous variations of the embodiments described above. For example, base 14 may be anchored to ground using a threaded anchor that is inserted into hole in base and screwed into the ground. Where two panels are utilized in housing, one panel could be used, or vice-versa. Indeed, the terms and descriptions used herein are set forth by way of illustration only and are not meant as limitations. Those skilled in the art will recognize that many variations are possible within the spirit and scope of the invention as defined in the following claims, and their equivalents, in which all terms are to be understood in their broadest possible sense unless otherwise indicated.

The invention claimed is:

1. A receptacle for secure mail and parcel receipt and storage comprising:

a housing that includes:

an upper compartment into which mail is first placed;

a lower compartment into which mail is deposited from the upper compartment;

a front door, located on a front of the receptacle, which is opened to provide access to the upper compartment and through which mail is placed into the upper compartment;

a trap door, operatively connected to the front door, in the upper compartment, and an access door that includes a lock, wherein the access door is unlocked and opened to provide access to the lower compartment, whereby mail deposited and stored in the lower compartment may be retrieved through the access door; and a base connected to the housing, wherein the base cooperates with an anchor which secures the receptacle to the ground, wherein the base is affixed to the anchor with rubber sleeves that fit over an end of the anchor, wherein the rubber sleeves expand in holes in the base when nuts are tightened on the rubber sleeves, and wherein a tight fit of the holes in the base around the expanded rubber sleeves affixes the base to the anchor.

2. The receptacle of claim 1, further comprising a top connected to the housing which provides a roof for the receptacle, wherein the top includes a flag for indicating the presence or absence of outgoing mail.

3. The receptacle of claim 1, wherein:

the trap door rests in an open position when the front door is closed, allowing communication between the upper and lower compartments;

the trap door is moved to a closed position by the opening of the front door, thereby preventing access to the lower compartment from the upper compartment; and the trap door returns to the open position when the front door is closed, depositing any mail placed in the upper compartment into the lower compartment.

4. The receptacle of claim 1 in which the front door includes a front door extension, wherein:

the front door extension extends into upper compartment;

the front door extension is in an open position when the front door is closed; and the front door extension pivots into a closed position when the front door is opened, whereby the front door extension is positioned underneath and supporting the trap door when in the closed position.

5. The receptacle of claim 4, wherein the front door extension includes a plurality of fingers that act to catch or snag devices used to attempt to access the lower compartment through the upper compartment.

6. The receptacle of claim 4, wherein the front door extension includes a cam that rotatably operates to lift the trap door into the closed position when the front door is opened.

7. The receptacle of claim 1, wherein the upper compartment further includes a outgoing mail shelf.

8. The receptacle of claim 1, wherein the lower compartment includes an adjustable shelf that may he raised or lowered to accommodate different amounts of deposited mail.

9. The receptacle of claim 1, wherein the access door lock is key-operated.

10. The receptacle of claim 1, wherein the access door pivots open or may be removed.

11. The receptacle of claim 1, wherein the access door is located on a rear of the receptacle, opposite the front on which the front door is located.

12. The receptacle of claim 1, wherein the access door is located on a side of the receptacle.

13. The receptacle of claim 1, wherein the anchor comprises a plurality of j-bolts.

14. The receptacle of claim 1, wherein the base is affixed to the anchor in a manner that enables the base to break away from the anchor if the receptacle is struck with a force.

15. The receptacle of claim 1, further comprising a top connected to the housing, wherein the top, base, and housing are substantially fabricated from a plastic that is a recyclable plastic.

* * * * *